US005758759A

United States Patent [19]

Negishi

[11] Patent Number: 5,758,759

[45] Date of Patent: Jun. 2, 1998

[54] OPTICAL DETECTION UNIT FOR PRINTED VALUE SHEET VALIDATION APPARATUS AND METHOD OF OPTICALLY DETECTING THE SHEET THEREFOR

[75] Inventor: Hiroyuki Negishi, Isesaki, Japan

[73] Assignee: Sanden Corp., Isesaki, Japan

[21] Appl. No.: 565,847

[22] Filed: Dec. 4, 1995

[30] Foreign Application Priority Data

Dec. 26, 1994 [JP] Japan ..... 6-322201

[51] Int. Cl.[6] ..... G07D 7/00

[52] U.S. Cl. ..... 194/207; 250/556

[58] Field of Search ..... 194/207; 209/534; 250/556; 356/71

[56] References Cited

U.S. PATENT DOCUMENTS

| | | | |
|---|---|---|---|
| 2,237,132 | 4/1941 | Christensen | 194/344 X |
| 3,578,846 | 5/1971 | Chen | 356/71 |
| 4,723,072 | 2/1988 | Naruse | 235/454 |

FOREIGN PATENT DOCUMENTS

| | | | |
|---|---|---|---|
| 2121533 | 12/1983 | United Kingdom | 250/556 |

*Primary Examiner*—F. J. Bartuska

*Attorney, Agent, or Firm*—Kenjiro Hidaka

[57] ABSTRACT

Apparatus and method for detecting a printed value sheet for printed value sheet validation apparatus is provided. Light is emitted from a light emitting element onto a first part of a printed value sheet on a first surface side thereof while the sheet is being transported so that a portion of the emitted light transmits through the sheet from the first surface side to a second surface side. The light having transmitted through the sheet to the second surface side is guided onto a second part of the sheet on the second surface side by a light guiding element so that a portion of the guided light transmits through the sheet back to the first surface side at the second part. A portion of the light so transmitted back to the first side is received by a light receiving element so as to be converted to an optical data pattern for analysis. A light emitter-receiver unit may be used in place of either the light emitting or the light receiving element so that the unit can also receive light that is emitted by itself and reflected back from the sheet.

9 Claims, 16 Drawing Sheets

OPTICAL DETECTION UNIT FOR PRINTED VALUE SHEET VALIDATION APPARATUS AND METHOD OF OPTICALLY DETECTING THE SHEET THEREFOR

BACKGROUND OF THE INVENTION

1. Field of the Invention

This invention pertains to an optical detection unit used for a printed value sheet validation apparatus that validates a printed value sheets such as bills, bank notes, securities or bonds, and a method of optically detecting the printed value sheets.

2. Description of the Prior Art

A typical example of conventional printed value sheet validation apparatuses is a bill (bank note) validation apparatus that is installed in an automatic vending machine.

FIG. 30 is a side elevational sectional view of a basic structure of a conventional vertical-type bill validation apparatus that is used for an automatic vending machine. For explanation purposes, the left-hand side as viewed in FIG. 30 is hereinafter called "front side" and the right-hand side "rear side". In FIG. 30, a bill validation apparatus 10 has a bill accommodation chamber 2 enclosed by a housing 201, which keeps validated bills 1 in a stack, and a vertical-type bill identification unit 300 in a housing 301 that is disposed on top of the housing 201.

The bill identification unit 300 has a bill transport mechanism 7 and an optical detection unit 310' that function in coordination with each other.

FIG. 31 shows a section taken along line F31–F31 of FIG. 30. Referring to FIGS. 30 and 31, the bill transport mechanism 7 has a generally inverted-U-shaped bill transport path 3 including an upward path 3*a* and a downward path 3*b*, sets of rollers 7*a*, and sets of roller-driven bill transport belts 8, 9 each disposed near a side end of the bill transport path 3. The inlet to the bill transport path 3 is a bill insertion slot 400 disposed on the front side of the apparatus 10 that is upwardly inclined in order to prevent rain water from entering. The optical detection unit 310' has a pair of circuit boards 311*a* and 311*b* disposed vertically on the front side and the rear side, respectively, of the downward path 3*b*. On the circuit boards 311*a* and 311*b* are mounted a light emitting element $L_s$ (an LED) and a light receiving element $L_R$(a photo transistor), respectively, in the proximity of the bill transport path 3 and directly opposing to each other. The bill transport path 3 is formed and defined by a first guide member 312 and a second guide member 313, which has a side guide 313*b* on each side. The first and the second guide members 312 and 313 have holes 312*a* and 313*a*, respectively, so as to accommodate therein the top parts of the light emitting and receiving elements $L_S$ and $L_R$, respectively.

As a bill is inserted to the bill insertion slot 400, a driving unit (not shown) causes the rollers 7*a*to be rotated so that the bill is transported on the belts 8, 9 along the bill transport path 3, first upwardly in the upward path 3*a*, turned around at the top, then downwardly in the downward path 3*b*. While the bill is transported between the light emitting and receiving elements $L_S$ and $L_R$, the light receiving element $L_R$ receives light energies having transmitted through the bill that represent print densities of the bill at the part where the light has transmitted through. The received light energy pattern is compared with a predetermined reference pattern, and validity of the bill is determined. If the bill is determined as genuine, the bill will be further transported to the bill accommodation chamber 2 to be kept therein. If the bill is determined as false or physically defective, the transport mechanism 7 will be driven in reverse and the bill will be sent back to the bill insertion slot 400. This is an example of using a light-transmission type optical bill detection unit.

FIG. 32 shows a principle of another type of conventional optical bill detection unit. Throughout this specification, like reference numerals or characters denote like components having like functions. Therefore, no duplicate explanations will be made on like components. In FIG. 32, a bill detection unit 310" has a light emitting and receiving elements $L_s$ and $L_R$ mounted on a common circuit board 311*a* side by side on one side of a bill transport path 3, tops of which are accommodated in a hole 312*a*" of the circuit board 312, so that a portion of the emitted light is reflected on the bill 1 and received by the light receiving element $L_R$. A relatively large circular hole 313*a*" is provided in the second guide member 313. This hole causes any light that transmits through the bill to radiate therethrough without reflecting on the second guide member 313 back to the bill and consequently transmitting through the bill in the reverse direction, thereby reaching the light receiving element $L_R$ as a noise element. The light energies received by the light receiving element $L_R$ represent the print density pattern on the bill at the part where the reflection occurred and this pattern is used to verify the bill. This is a light-reflection type optical bill detection unit.

FIG. 33 is a side sectional view of a basic structure of a conventional horizontal-type bill identification unit used for an automatic vending machine. A bill identification unit 500 includes a bill transport mechanism 7 and an optical bill detection unit 510 that function in coordination with each other.

FIG. 34 shows a section of the optical bill detection unit 510 taken along line F34—F34 of FIG. 33.

Referring to FIGS. 33 and 34, the transport mechanism 7 has a horizontal bill transport path 3, first set of rollers 710 with a pair of endless belts 711, each disposed near each side end of the transport path (details not illustrated), and a second set of rollers 720 with belts 721, each disposed near each side end of the transport path and immediately under the first roller-belt unit so that the bill 1 is conveyed in the bill transport path 3 between the belts 711 and 721.

The optical detection unit 510 has a pair of circuit boards 311*a* and 312*a* disposed horizontally on the top side and the under side, respectively, of the bill transport path 3. On the underside of the circuit board 311*a* is mounted a pair of light emitting elements $L_{S1}$ and $L_{S2}$, spaced apart from each other, and on the topside of the circuit board 312*a* is mounted a pair of light receiving elements $L_{R1}$ and $L_{R2}$, spaced apart from each other, in the manner that the light emitting elements $L_{S1}$ and $L_{S2}$ vertically oppose the light receiving elements $L_{R1}$ and $L_{R2}$, respectively, leaving a gap of the bill transport path 3 therebetween. The bill transport path 3 is formed and defined by a top guide member 312 and a bottom guide member 313, which has a side guide 313*b* on each side. Each of the top and the bottom guide members 312 and 313 has a pair of holes 312*d*, 312*e* and 313*d*, 313*e*, respectively, so as to accommodate therein the top parts of the light emitting elements $L_{S1}$, $L_{S2}$, and light receiving elements $L_{R1}$, $L_{R2}$, respectively. The inlet to the bill transport path 3 is a bill insertion slot 520.

As the bill 1 is inserted to the bill insertion slot 520, a driving unit (not shown) causes the set of rollers 710, 720 and belts 711, 721 to be actuated so that the bill is conveyed between the belts 711 and 721 in the bill transport path 3.

While the bill is transported between each pair of the light emitting and receiving elements $L_{S1}/L_{R1}$ and $L_{S2}/L_{R2}$. The light receiving elements $L_{R1}$ and $L_{R2}$ receive respective light energies having transmitted through the bill that represent print densities of the bill at the parts where the respective lights have transmitted through. The received light energy patterns are compared with predetermined reference patterns so that the validity of the bill is determined. If the bill is determined as genuine, the bill will be further transported to a bill accommodation chamber (not shown), and if the bill is determined as false or physically defective, the transport mechanism 7 will be driven in reverse and the bill will be sent back to the bill insertion slot 520, in the same manner as in the case of the vertical-type bill identification unit shown in FIG. 30.

FIG. 35 is a graph showing a received light amount curve (C1) of the light receiving element $L_{R1}$ of the optical detection unit shown in FIG. 34. FIG. 36 is a graph showing a received light amount curve (C2) of the light receiving element $L_{R2}$ of the optical detection unit shown in FIG. 34. The "CT" axes represent the amounts of lights that have been transmitted through the bill 1 and are received by the respective light receiving elements. The maximum level of $C_T$ represents the stand-by state, when the bill is not present between the corresponding pair of the light emitting and receiving elements. The "M" axes represent travel distance of the bill 1 measured from a predetermined position, which is substantially proportional to elapsed time. The received light amount curves C1 and C2 are different from each other because different parts, each having different print density pattern, of the bill respectively pass between the two pairs of the light emitting and receiving elements $L_{s1}/L_{R1}$ and $L_{S2}/L_{R2}$. In this case, since dual optical data are obtained from the two pairs of light elements so as to be compared with respective dual predetermined reference data, the validation accuracy is improved as compared with the examples shown in FIGS. 31 and 32, in which only one pair of light elements is used. Naturally, as the number of pairs of the light elements is increased, the validation accuracy will be improved but the system will become more complex and costly.

Efforts have been made to minimize the size of a bill validation apparatus for an automatic vending machine, for the following reasons:

(1) It is required to minimize the overall size of the vending machine.

(2) Particularly for the vending machines installed outdoors, security measures against thefts, tampering or use of forged bills need be taken into consideration, and an additional space to accommodate a security device therefor is required.

Furthermore, electronic components, including the optical elements, in an outdoor-installed vending machine must be arranged so as to be kept from rain water or moisture. Needless to say, the accuracy of the validation apparatus should always be improved without an added complexity or production cost.

The conventional optical bill detection unit shown in FIG. 34, for example, employs two pairs of light emitting and receiving elements to improve the validation accuracy, but at a sacrifice of production cost. The two separate relatively large-size circuit boards 311*a*, 312*a*, one on the upper side and the other on the under side of the bill transport path 3, have to be used to secure the two pairs of light elements in position. Even the optical detection unit shown in FIG. 31, having only one pair of light elements, requires two circuit boards.

The reflection-type optical detection unit 310" shown in FIG. 32 has an advantage in that only one relatively small-size circuit board 311*a* is required on one side of the bill transport path and only one pair of light elements mounted thereon. This system, however, provides optical data representing print densities of only one part of the bill. The validation accuracy, therefore, will be inferior to that of the unit 510 shown in FIG. 34.

SUMMARY OF THE INVENTION

In view of the above discussed situation, the primary object of the present invention is to provide an optical detection unit for a printed value sheet optical validation apparatus that is compact, simple in construction, economical, yet capable of providing a high validation accuracy, and a method of detecting a printed value sheet used for a printed value sheet optical validation apparatus.

A brief explanation will now be made about the basic structure of the optical detection unit for a printed value sheet validation apparatus according to the present invention. The optical detection unit has at least one light emitting element that emits light beam onto a first part of a printed value sheet on a first surface side of the sheet that is being transported in a predetermined direction in a sheet transport path so that a portion of the emitted light transmits through the sheet from the first surface side to a second surface side of the sheet. The optical detection unit also has at least one light guiding element, disposed on the side of the second surface side of the sheet, that guides the light having transmitted through the sheet from the first surface side to the second surface side onto a second part of the sheet on the second surface side so that a portion of the guided light transmits through the sheet from the second surface side to the first surface side at the second part of the sheet. The optical detection unit additionally has at least one light receiving element that receives a portion of the light having transmitted through the sheet at the second part from the second surface side to the first surface side, so that the light received is converted to an optical data pattern for analysis.

The light emitting element and the light receiving element are always disposed on the side of the same surface side of the object sheet, or the same side of the sheet transport path, and are optically connected with each other by the light guiding element disposed on the side of the other surface side of the sheet. Therefore, the light emitted from the light emitting element and reaching the light receiving element by way of the light guiding element transmits through the sheet at least two different parts of the sheet.

In other embodiment of the present invention, a unit of a light emitting and a light receiving element is used in place of the light emitting or the light receiving element described above so that the unit also receives a portion of the light emitted by itself and reflected back from the sheet surface.

Since the light emitting element and the light receiving element are always disposed on one side of the sheet, and the light guiding element, such as an optical fiber, is disposed on the other side, the optical detection unit of the present invention has advantages such as a fewer number of circuit board, compactness, simplicity in construction, and low production cost.

DETAILED DESCRIPTION OF THE PREFERRED EMBODIMENTS

The present invention of optical detection unit for value sheet validation apparatus will now be described in detail in reference to the drawings. Although the object sheet of the validation discussed in the following embodiments is a bill (bank note), any appropriate printed value sheets may be substituted for the bill.

Figure 1:
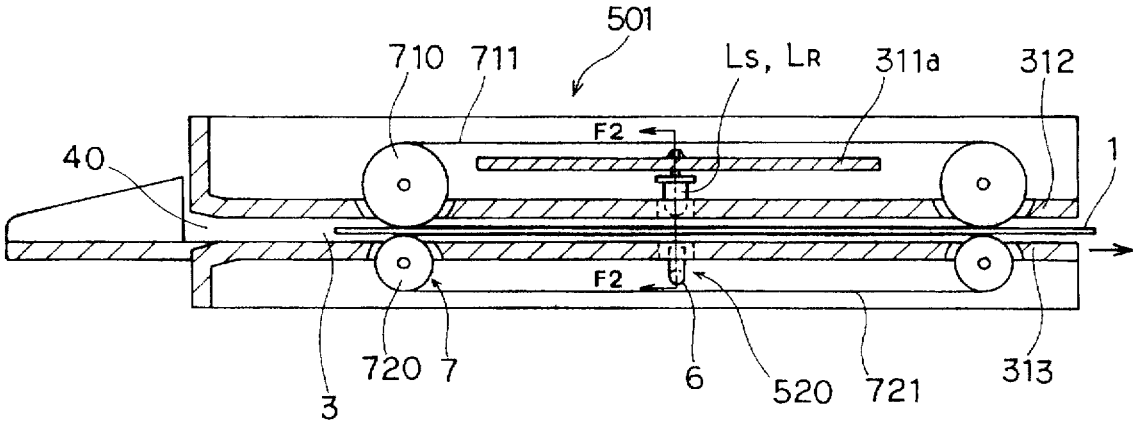
FIG. 1 is a side sectional view of a horizontal-type bill identification unit of a bill validation apparatus in which an optical detection unit according to the first embodiment of the present invention is employed.
Figure 2:
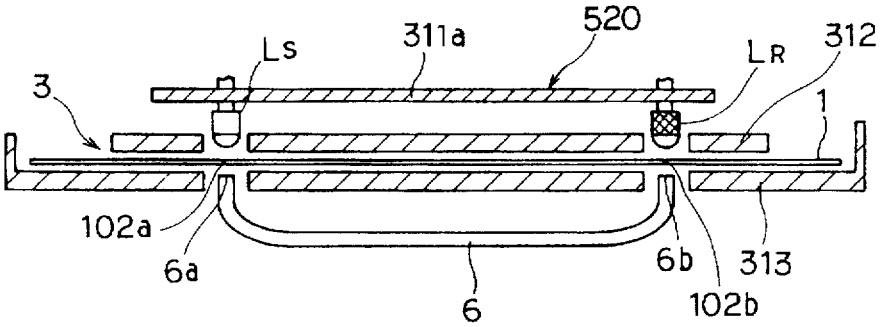
FIG. 2 is a sectional view, taken along line F2—F2 of FIG. 1, of the optical detection unit of the first embodiment.

FIG. 1 is a side sectional view of a horizontal-type identification unit for a bill validation apparatus, in which an optical detection unit according to the first embodiment of the present invention is employed. FIG. 2 is a section taken along line F2—F2 of FIG. 1.

Figure 33:
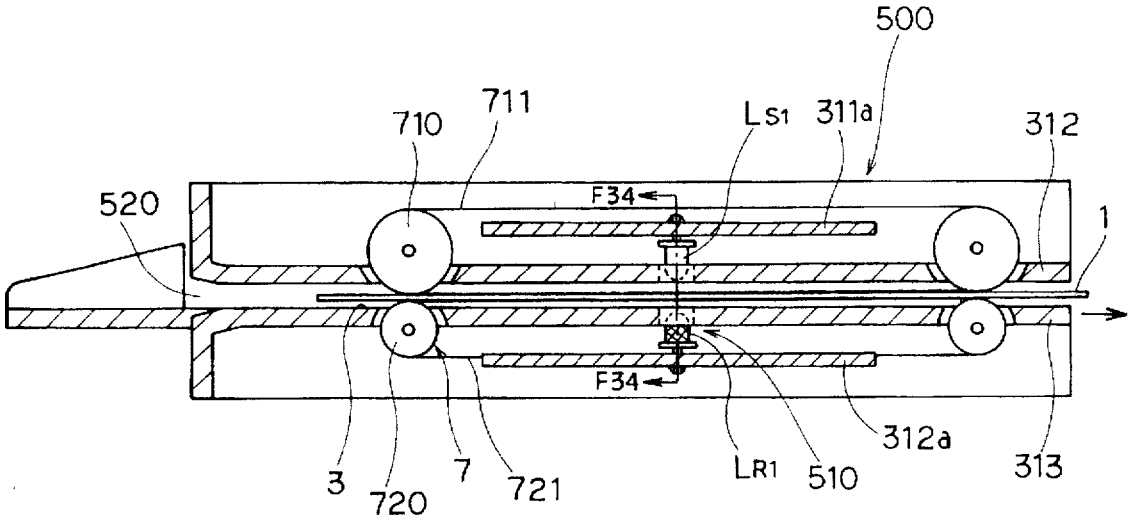
FIG.33 PRIOR ART
FIG. 33 is a side sectional view of a horizontal-type bill identification unit employing a conventional optical detection unit.

Referring to FIG. 1, a horizontal-type bill identification unit 501 has a bill transport mechanism 7 and an optical detection unit 520. The structure and the functions of the components bearing the same reference characters in FIGS. 1 and 2 are identical or very similar to those of the conventional bill identification unit 500 described in detail above in reference to FIG. 33 except those of the optical detection unit 520 that is different from the conventional optical detection unit 510 shown in FIG. 33. Detail explanation will now be made on the optical detection unit 520 of the present invention in reference to FIGS. 1 and 2.

The optical detection unit 520 has a circuit board 311*a* disposed horizontally on the top side of the bill transport path 3. On the underside of the circuit board 311*a* and in the proximity of the bill transport path 3 are mounted a light emitting element $L_S$ and a light receiving element $L_R$, spaced apart from each other and aligned in a horizontal line orthogonal to the bill transport direction. Unlike the case of the conventional optical detection unit 510 shown in FIG. 33, both of the light emitting and receiving elements $L_S$, $L_R$ are disposed on one side (the top side in this case) of the bill transport path 3, i.e. the same surface side of the bill 1 in the proximity of thereof. An optical fiber 6 is disposed on the other side (the bottom side in this case) of the bill transport path 3. The optical fiber 6 has upwardly directed first and second ends 6*a* and 6*b* disposed underside the bill transport path 3 in the proximity thereof vertically opposing the light emitting element $L_s$and the light receiving element $L_R$, respectively, so that the light emitting and receiving elements $L_s$ and $L_R$ are optically connected with each other by way of the optical fiber 6. The light emitting and receiving elements $L_S$ and $L_R$ and the first and second ends 6*a* and 6*b*, respectively, of the optical fiber 6 have respective common vertical center axes.

As the bill 1 is transported into the optical detection unit 520 in the bill transport path 3, a portion of the light emitted by the light emitting element $L_S$ onto the bill on the top surface side thereof will transmit through the bill to the bottom surface side thereof at a part 102*a* directly under the light emitting element $L_S$. A portion of the light transmitted through the bill at the part 102*a* from the top surface side to the bottom surface side will enter the optical fiber 6 from the first end 6*a* thereof and will be guided therethrough, from the first end 6*a* to the second end 6*b*. The light having exited from the second end 6*b* will be directed onto the bill on the bottom surface side thereof at a part 102*b* directly under the light receiving element $L_R$. Then, a portion of the light guided by the optical fiber 6 will transmit through the bill at the part 102*b* to the top surface side thereof, and a portion of the light that has so transmitted through the bill will be received by the light receiving element $L_R$.

Namely, a portion of the light energy emitted from the light emitting element $L_S$ will be received by the light receiving element $L_R$ after transmitting through the bill 1 twice, the first time from the top surface side to the bottom surface side and the second time from the bottom surface side to the top surface side, and at a different location of the bill each time. The light receiving element $L_R$ receives an amount of light energy after the transmitted light has been attenuated while the light transmits through the bill twice. The amount of the light attenuation reflects the densities of the prints at the locations of the bill where the light transmits through while the bill is in motion. The light energy pattern received through the light receiving element $L_R$ is the data that is analyzed to validate the bill. The validation of the bill is performed by comparing the light energy pattern obtained by the optical detection unit with a predetermined reference pattern.

Figure 3:
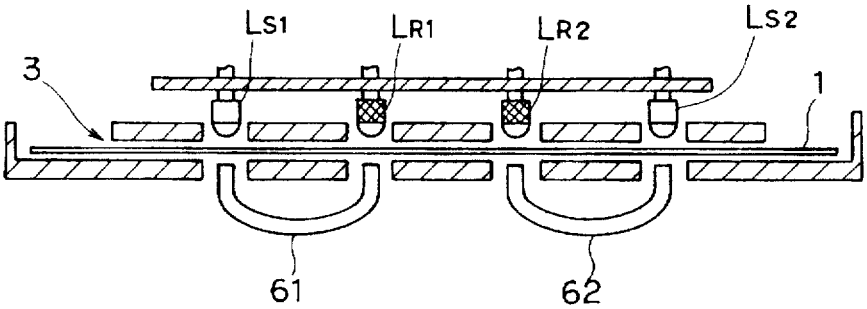
FIG. 3 shows an alternate embodiment of the optical detection unit shown in FIGS. 1 and 2.

FIG. 3 sectionally shows an optical detection unit of an alternate embodiment of the first embodiment. The difference of this embodiment from the first embodiment is that, in addition to a first set of light emitting and receiving elements $L_{S1}$, $L_{R1}$ and an optical fiber 61, a second set of light emitting and receiving elements $L_{S2}$, $L_{R2}$ and an optical fiber 62 is arranged in alignment with a line orthogonal to the bill transport direction within the height of the bill 1. The function of each set of the optical elements in this alternate embodiment is identical to that of the first embodiment explained above.

Figure 4:
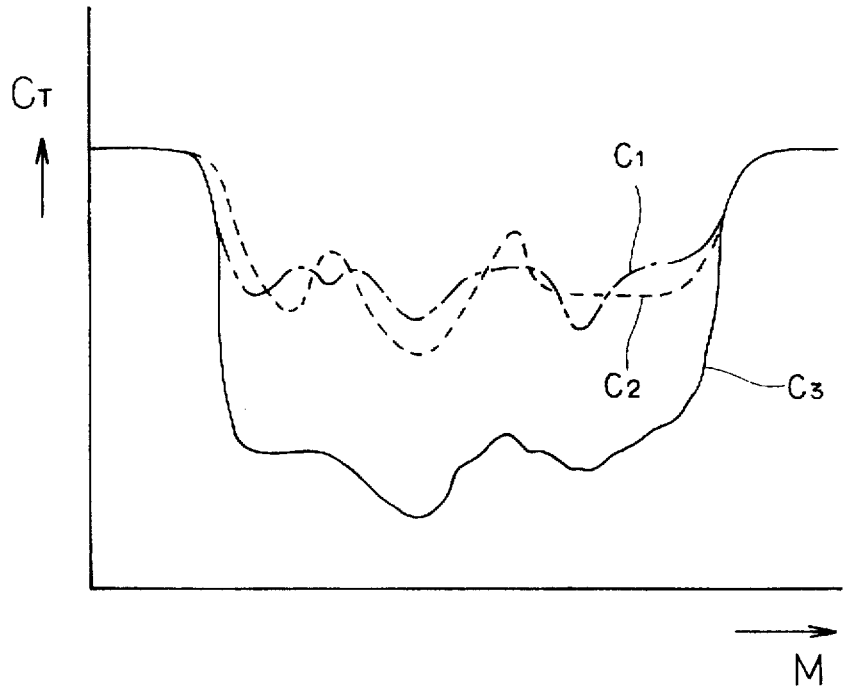
FIG. 4 is a graph comparatively showing amounts of lights, having transmitted through a bill, obtained by optical detection units of the present invention and of a conventional type.
Figure 34:
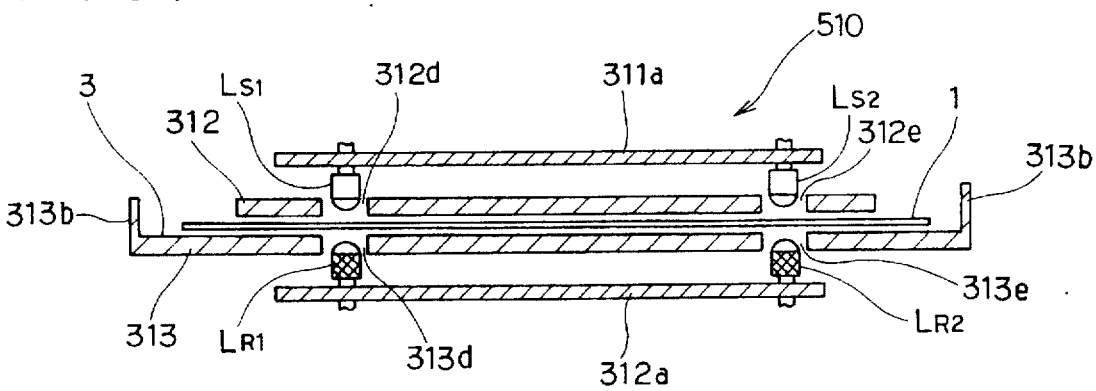
FIG.34 PRIOR ART
FIG. 34 is a sectional view, taken along line F34—F34 of FIG. 33, of the conventional optical detection unit.
Figure 35:
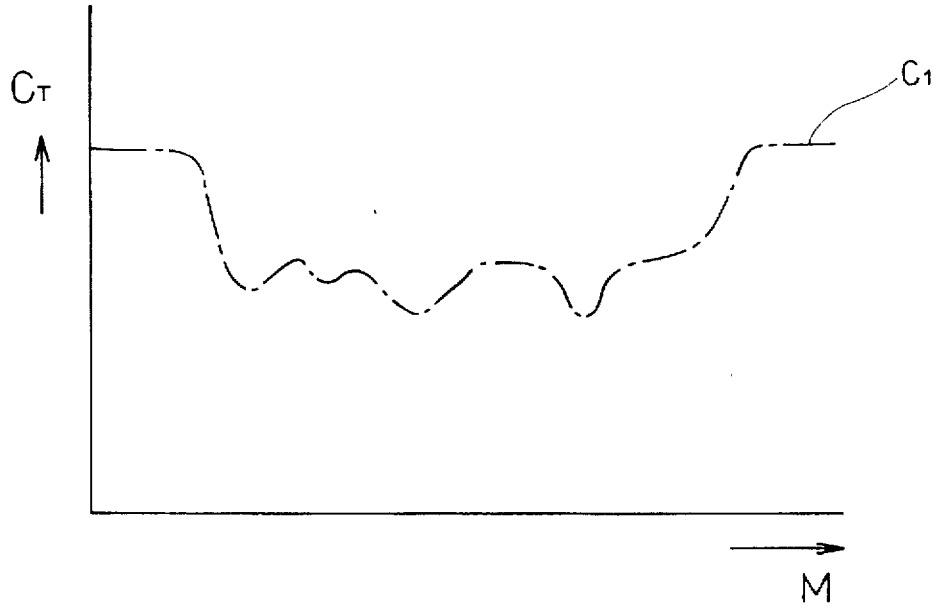
FIG.35 PRIOR ART
FIG. 35 is a graph showing a first received light amount curve obtained by the conventional optical detection unit shown in FIG. 31.
Figure 36:
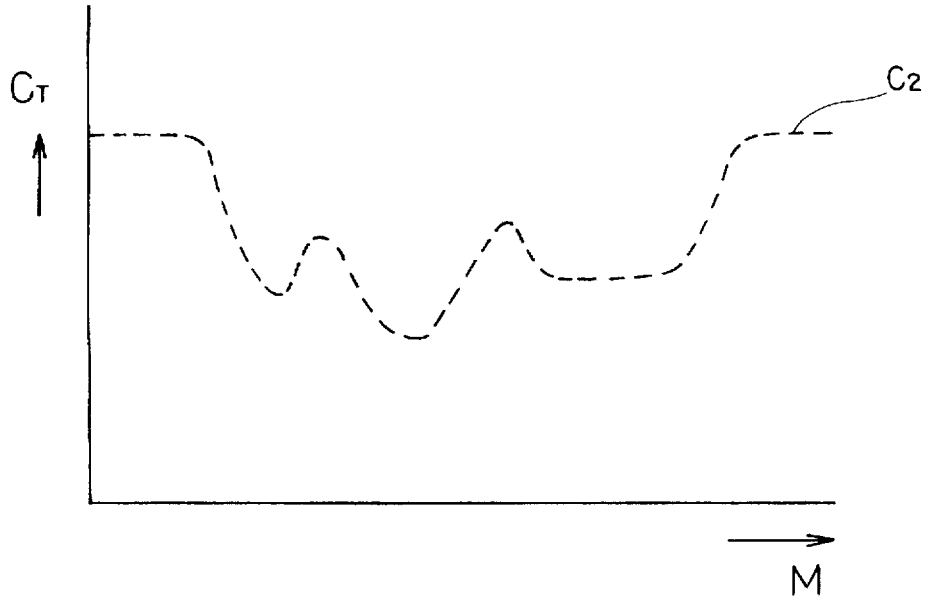
FIG.36 PRIOR ART
FIG. 36 is a graph showing a second received light amount curve obtained by the conventional optical detection unit shown in FIG. 31.

FIG. 4 is a graph comparatively showing amounts of lights, which vary according to the travel distance of the bill 1, received by the light receiving element $L_R$ shown in FIGS. 1 and 2 and the light receiving elements $L_{R1}$ and $L_{R2}$ in FIG. 34. In FIG. 4, the vertical axis represents the amount of received light ($C_T$) and the horizontal axis represents the travel distance (M) of the bill 1 from a predetermined point in the bill transport path 3. The broken line C1 is a copy of the line C1 shown in FIG. 35, which is a received light amount curve of the light receiving element $L_{R1}$ shown in FIG. 34, and the dashed line C2 is a copy of the line C2 shown in FIG. 36, which is a received light amount curve of the light receiving element $L_{R1}$shown in FIG. 34. The solid line C3 in FIG. 4 represents the amounts of light energies received by the light receiving element $L_R$ shown in FIGS. 1 and 2. The maximum light amount level in the graph represents the stand-by state, when the light transmission path of the optical detection unit is not yet interrupted by the bill. The reduced light amount values from the maximum value of C1, C2 and C3 represent the amounts of the lost light energies as the respective lights transmit through the bill. It will be understood that the reduced light amount values of C3 are the sums of the reduced light amount values of C1 and C2. Assuming that the positions of the light emitting and receiving elements $L_S$ and $L_R$ of FIG. 2 are identical to the positions of the light emitting elements $L_{S1}$ and $L_{S2}$, respectively, of FIG. 34, the sum of the individually lost light energies of the two separate light beams while individually transmitting through the bill 1 at the two separate positions (as shown in FIG. 34) is equal to the total lost light energy of a single light beam that transmits through the bill twice at the identical two positions of the bill 1 (as shown in FIG. 2). In other words, the two characteristic curves C1 and C2 of the transmitted light amounts ($C_T$) shown in FIGS. 35 and 36, respectively, which are obtained by two separate pairs of light emitting and receiving elements in a conventional manner, is represented by only one characteristic curve C3 shown in FIG. 4, which is obtained by only one pair of light emitting and receiving elements according to the present invention. In the present invention, therefore, since the sum of the lost light energy data at two different positions of the bill can be obtained with only one light beam between one pair of light emitting and receiving elements, the optical detection unit can be made much simple and compact as compared with that of a conventional type.

Figure 5:
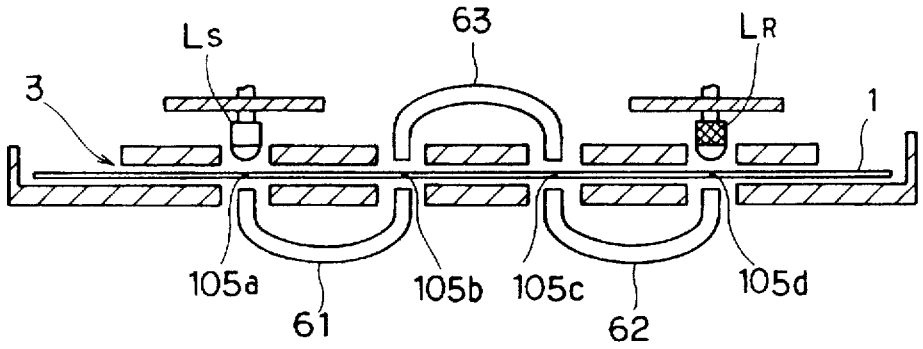
FIG. 5 sectionally shows an optical detection unit according to the second embodiment of the present invention.

FIG. 5 shows a basic structure of an optical detection unit of a bill validation apparatus according to the second embodiment of the present invention. The optical detection unit of the second embodiment has one pair of light emitting and light receiving elements $L_S$, $L_R$, which are disposed on the top side of the bill transport path 3, or the top surface side of the bill 1, a first optical fiber 61 and a second optical fiber 62, both of which are disposed on the bottom side of the bill transport path 3, or the bottom surface side of the bill 1, and a third optical fiber 63, which is disposed on the top side of the bill transport path 3, or the top surface side of the bill 1, in a manner that the light emitting and receiving elements $L_S$ and $L_R$ are optically connected with each other by way of the three optical fibers 61, 63 and 62. The light beam emitted from the light emitting element $L_s$ downwardly transmits through the bill 1 at a part 105*a*, enters the first optical fiber 61 and transmits therethrough, upwardly exits therefrom, transmits through the bill second time at a part 105*b*, enters the third optical fiber 63 on the top side of the bill and transmits therethrough, downwardly exits therefrom, transmits through the bill third time at a part 105*c*, enters the second optical fiber 62 and transmits therethrough, upwardly exits therefrom, transmits through the bill fourth time at a part 105*d*, then, reaches the light receiving element $L_R$. In other words, a portion of the light beam emitted from the light emitting element $L_S$ is received by the light receiving element $L_R$ after having transmitted through the bill 1 four times at the four different parts 105*a*, 105*b*, 105*c* and 105*d*, which are aligned in a line orthogonal to the bill transport direction, of the bill by way of the optical fibers 61, 63 and 62.

Figure 6:
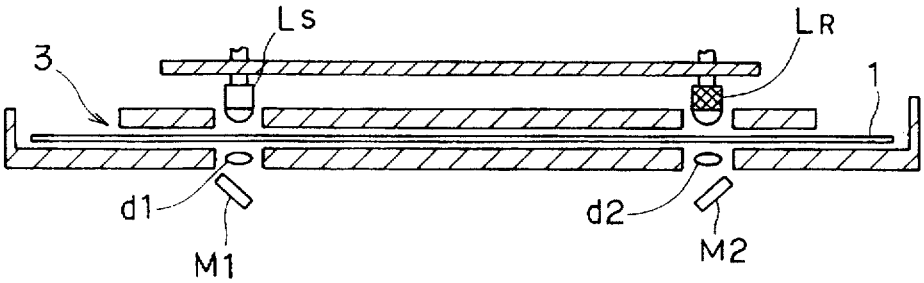
FIG. 6 sectionally shows an optical detection unit according to the third embodiment of the present invention.

FIG. 6 shows a basic structure of an optical detection unit for a bill validation apparatus according to the third embodiment of the present invention. This embodiment is similar to the first embodiment shown in FIGS. 1 and 2. The only difference between these two embodiments is that the third embodiment employs a combination of a pair of lenses d1, d2 and a pair of mirrors M1, M2 as the substitute for the optical fiber 6 in the first embodiment. In this third embodiment, the light emitting element $L_S$ and the light receiving element $L_R$ are optically connected through an optical channel that has the set of lens d1 and mirror M1 and the set of lens d2 and mirror M2. Functionally, the third embodiment is identical to the first embodiment.

Figure 7:
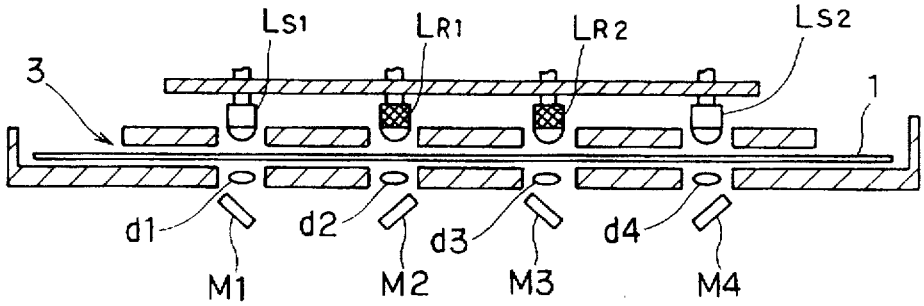
FIG. 7 sectionally shows an alternate embodiment of the optical detection unit of the third embodiment shown in FIG. 6.

FIG. 7 shows an alternate embodiment of the third embodiment. The difference of this embodiment from the third embodiment is that, in addition to a first set of light emitting and receiving elements $L_{S1}$, $L_{R1}$ and a combination of a pair of lenses d1, d2 and a pair of mirrors M1, M2, a second set of light emitting and receiving elements $L_{S2}$, $L_{R2}$ and a combination of a pair of lenses d3, d4 and a pair of mirrors M3, M4 is arranged in alignment with a line orthogonal to the bill transport direction within the height of the bill 1. The function of each set of the optical elements in this embodiment is identical to that of the first or the third embodiment explained above.

Figure 8:
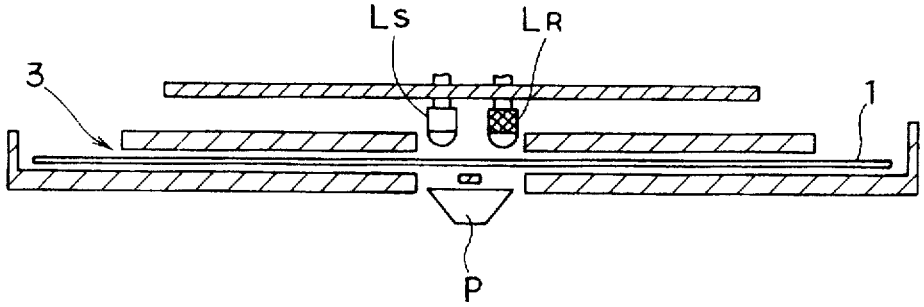
FIG. 8 sectionally shows an optical detection unit according to the fourth embodiment of the present invention.

FIG. 8 shows a basic structure of an optical detection unit for a bill validation apparatus according to the fourth embodiment of the present invention. This embodiment is also similar to the first embodiment shown in FIGS. 1 and 2. The main difference between these two embodiments is that the fourth embodiment employs a prism P as the substitute for the optical fiber 6 in the first embodiment. In this fourth embodiment, the light emitting element $L_S$ and the light receiving element $L_R$ are optically connected by the prism P. The basic function of the fourth embodiment is also the same as that of the first embodiment.

Figure 9:
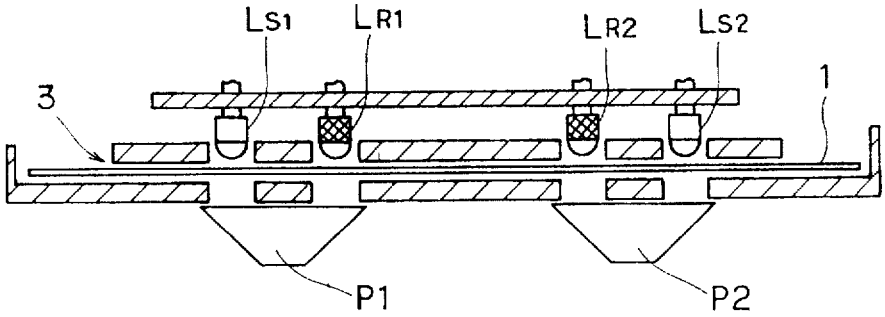
FIG. 9 sectionally shows an alternate embodiment of the optical detection unit of the fourth embodiment shown in FIG. 8.

FIG. 9 shows an alternate embodiment of the fourth embodiment. The difference of this embodiment from the fourth embodiment is that, in addition to a first set of light emitting and receiving elements $L_{S1}$, $L_{R1}$ and a prism P1, a second set of light emitting and receiving elements $L_{S2}$, $L_{R2}$ and a prism P2 is arranged in alignment with a line orthogonal to the bill transport direction within the height of the bill 1. The function of each set of the optical elements in this embodiment is identical to that of the fourth embodiment explained above.

Figure 10:
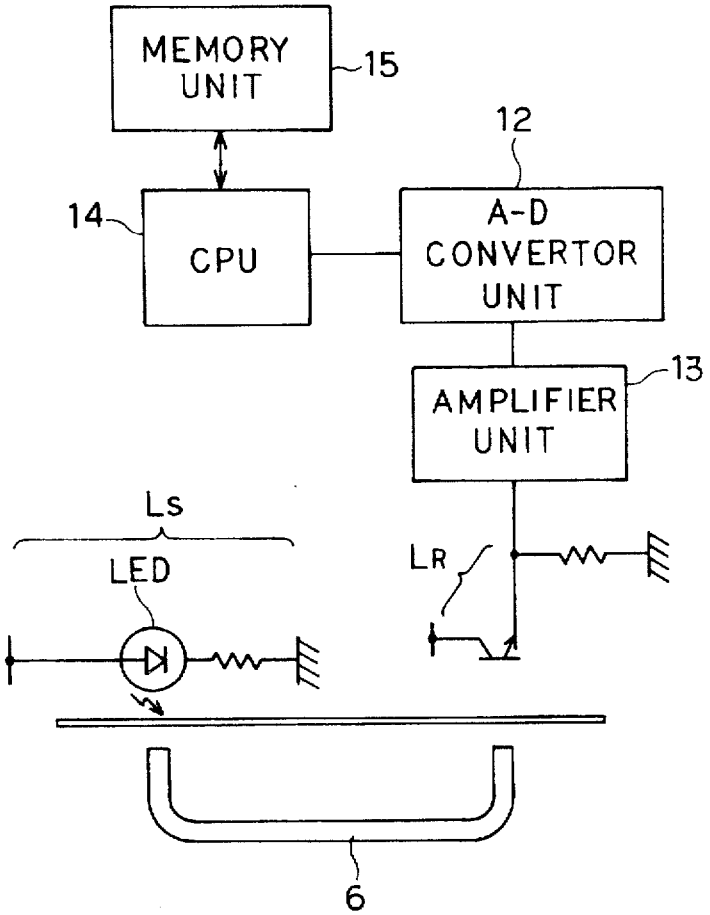
FIG. 10 is a control circuit diagram for the optical detection units of the first to fourth embodiments shown in FIGS. 1, 2, 5, 6, and 8.

FIG. 10 shows a control circuit diagram together with the optical elements for the optical detection units of the first to fourth embodiments shown in FIGS. 1, 2, 5, 6, and 8 that utilize a single pair of light emitting and receiving elements $L_s$, $L_R$. The control circuit includes an amplifier unit 13, which is electrically connected with the light receiving element $L_R$, an A-D convertor unit 12, which is electrically connected with the amplifier unit 13, a central processing unit (CPU) 14, which is electrically connected with the A-D convertor unit 12, and a memory unit 15, which is electrically connected with the CPU 14. The CPU performs data analyzing process with various data including the optical data obtained from the transmitted lights collected by the light receiving element $L_R$. The memory unit 15 stores necessary information for the CPU 14 to perform the processing. Light emitting diode (LED) is utilized for the light emitting element $L_s$ and a photo transistor is utilized for the light receiving element $L_R$.

Figure 11:
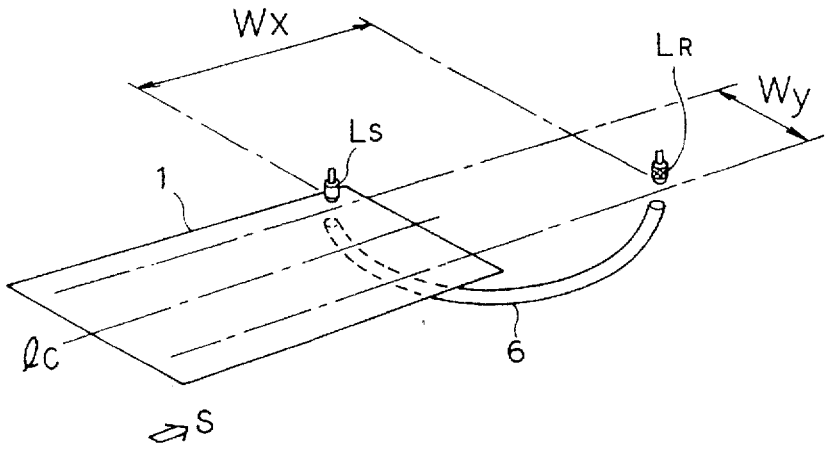
FIG. 11 is a perspective view particularly illustrating a positional arrangement of the light elements for a special alternate embodiment of the optical detection unit of the first embodiment shown in FIGS. 1 and 2.

FIG. 11 is a perspective view illustrating a special positional relation among the light emitting element $L_S$, the light receiving element $L_R$, the optical fiber 6, and the bill 1 in a special alternate embodiment of the optical detection unit of the first embodiment shown in FIGS. 1 and 2. In FIG. 11, the arrow affixed with the letter "S" indicates the direction in which the bill 1 is transported. The letters "lc" denote the longitudinal center line of the bill. The letters "Wx" represent the distance between the light emitting and receiving elements $L_S$ and $L_R$ measured in the bill transport direction S, and the letters "Wy" represent the distance between the light emitting and receiving elements $L_S$ and $L_R$ measured in the direction orthogonal to the bill transport direction S. In this case, the distance Wy is smaller than the height of the bill 1 and the distance Wx is smaller than the longitudinal dimension (i.e. width) of the bill. In the first embodiment shown in FIGS. 1 and 2, the light emitting element $L_S$, the light receiving element $L_R$, and the optical fiber 6 are disposed in alignment with a line orthogonal to the bill transport direction. However, in this special alternate embodiment of the first embodiment, the light receiving element $L_R$ is disposed away from the light emitting element $L_S$ in the bill transport direction S, and the optical fiber 6 is accordingly disposed between the two positions immediately under the light emitting element $L_S$ and the light receiving element $L_R$ at an angle to a line orthogonal to the bill transport direction S.

Figure 12:
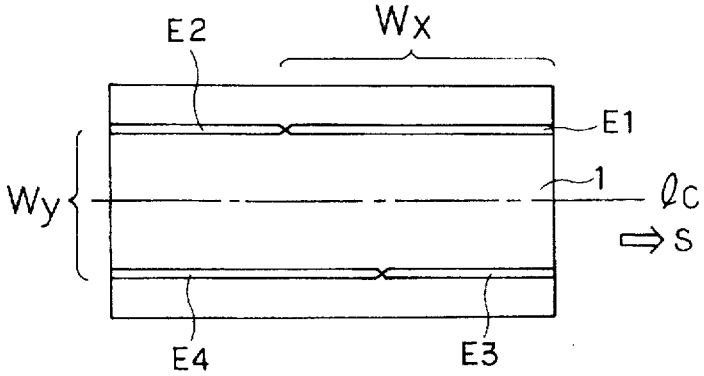
FIG. 12 shows optical sensing regions of a bill according to the positional arrangement of the optical elements shown in FIG. 11.

FIG. 12 shows optical sensing regions of the bill according to the special positional arrangement of the optical elements shown in FIG. 11. The bill 1 has strip-formed optical sensing regions El, E2, E3 and E4.

Referring to FIGS. 11 and 12, after the leading edge of the bill 1 has reached immediately under the light emitting element $L_S$ , the sensing region E2 in the bill will be subjected to the light beam emitted from the light emitting element $L_S$ and the variation of the light amount received by the light receiving elements $L_R$ will be sampled for a time period. At this time, no part of the bill is interposed between the light receiving element $L_R$ and the optical fiber 6. After the leading edge of the bill 1 has reached immediately under the light receiving element $L_R$, the sensing region E2 will be interposed between the light emitting element $L_S$ and the optical fiber 6, and the sensing region E3 will be interposed between the light receiving element $L_R$ and the optical fiber 6. At this time, the light being received by the light receiving element $L_R$ has transmitted through the bill twice, first time in the region E2 and the second time in the region E3. The variation of the light amount received by the light receiving element $L_R$, after twice attenuated by the bill, will also be sampled for a time period. After the trailing edge of the bill has passed immediately under the light emitting element $L_S$, no part of the bill will be interposed between the light emitting element $L_S$ and the optical fiber 6, and the light beam will be attenuated by the bill only once in the region E4 between the light receiving element $L_R$ and the optical fiber 6. The variation of the light amount received by the light receiving element $L_R$, after once attenuated by the bill, will likewise be sampled for the time period until the trailing edge of the bill has passed under the light receiving element $L_R$.

Figure 13:
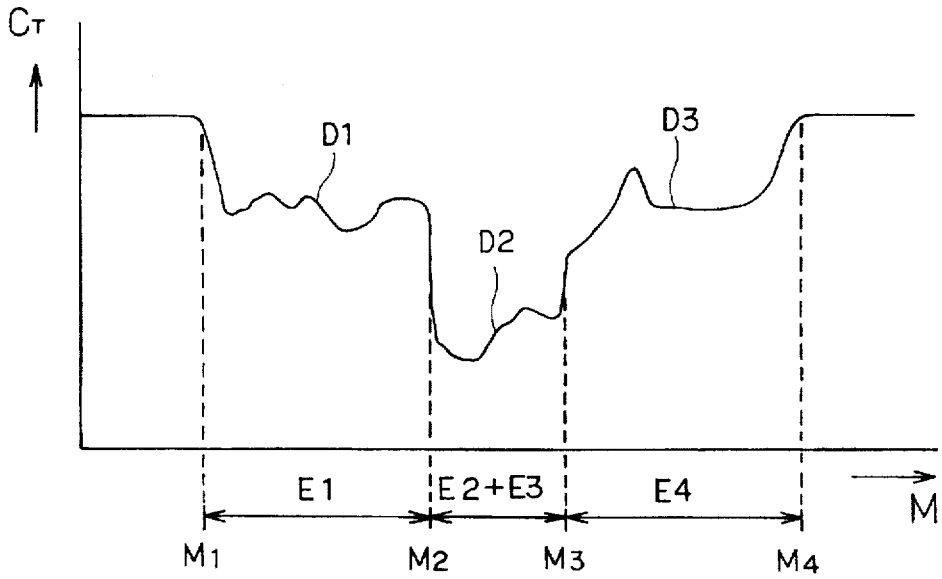
FIG. 13 shows a sampled data pattern of the received light amounts obtained by the optical detection unit according to the special positional arrangement of the optical elements as shown in FIG. 11.

FIG. 13 shows a sampled data pattern of the received light amounts obtained by the optical detection unit of the present invention, according to the special positional arrangement of the optical elements as shown in FIG. 11, in which the light amount ($C_T$) varies as the travel distance (M) of the bill varies. Referring to FIG. 13 in conjunction with FIGS. 11 and 12, "M1", "M2", "M3" and "M4 " respectively represent the travel distances of the bill 1 when the leading edge of the bill 1 reaches immediately under the light emitting element $L_S$, when the leading edge reaches immediately under the light receiving element $L_R$, when the trailing edge of the bill 1 has just passed under the light emitting element $L_S$, and when the trailing edge has just passed under the light receiving element $L_R$. The flat maximum $C_T$ level represents the stand-by state when the bill is not in the optical detection unit.

Still referring to FIG. 13 in conjunction with FIGS. 11 and 12, a first optical data pattern D1 is obtained when the bill 1 is within the travel distance range between "M1" and "M2", when the light beam transmits through the optical sensing region E1; a second optical data pattern D2 is obtained when the bill is within the travel distance range between "M2" and "M3", when the light beam transmits through both the optical sensing regions E2 and E3; and a third optical data pattern D3 is obtained when the bill is within the travel distance range between "M3" and "M4", when the light beam transmits through the optical sensing region "E4".

The second optical data pattern D2 is obtained from the light beam sensed by the light receiving element $L_R$ that is twice attenuated by the bill 1, one time in the optical sensing region E2 and the other time in the region E3.

However, in reference to FIG. 11, if the dimension Wx is made greater than the longitudinal dimension (i.e. width) of the bill 1, the light beam will not transmit through the bill 1 more than once, and the optical light patterns obtained in such a case will not include a pattern of twice attenuated light energy, such as "D2" in FIG. 13.

Figure 14:
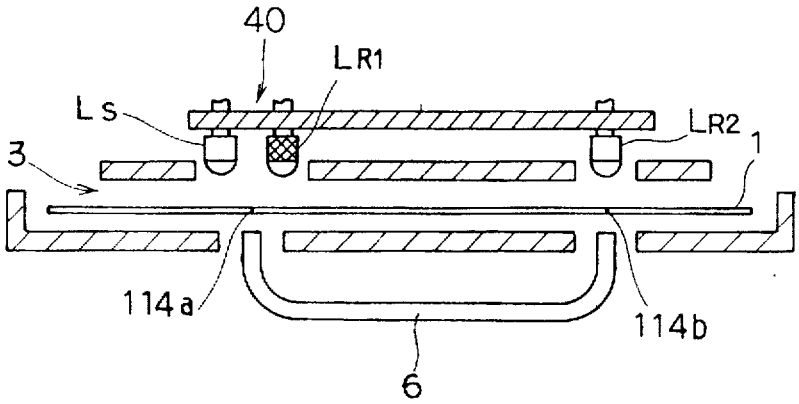
FIG. 14 sectionally shows an optical detection unit according to the fifth embodiment of the present invention.

FIG. 14 shows a basic structure of an optical detection unit for a bill validation apparatus according to the fifth embodiment of the present invention. In FIG. 14, a light emitting element $L_s$ and a first light receiving element $L_{R1}$, which are actually combined to each other to form a light emitter-receiver unit 40, and a second light receiving element $L_{R2}$ are disposed, apart from each other, on the top side, and in the proximity, of a bill transport path 3 in alignment with a line orthogonal to the bill transport direction. An optical fiber 6 disposed on the under side, and in the proximity, of the bill transport path 3, in alignment with a line orthogonal to the bill transport direction, in a manner that the light emitting element $L_s$ is optically connected with the second light receiving element $L_{R2}$ by the optical fiber 6.

In the fifth embodiment, a portion of the light emitted from the light emitting element $L_s$ is reflected on the bill 1 at a part 114*a*, directly under the light emitting element $L_s$, in the bill transport path 3 and is received by the first light receiving element $L_{R1}$ as the first data element of the bill 1. Another portion of the light emitted from the light emitting element $L_s$ will transmit through the bill 1 at the part 114*a*, then through the optical fiber 6, and through the bill 1 second time at a part 114*b*, directly under the second light receiving element $L_{R2}$, and will be received by the second light receiving element $L_{R2}$ as the second data element of the bill 1.

Figure 15:
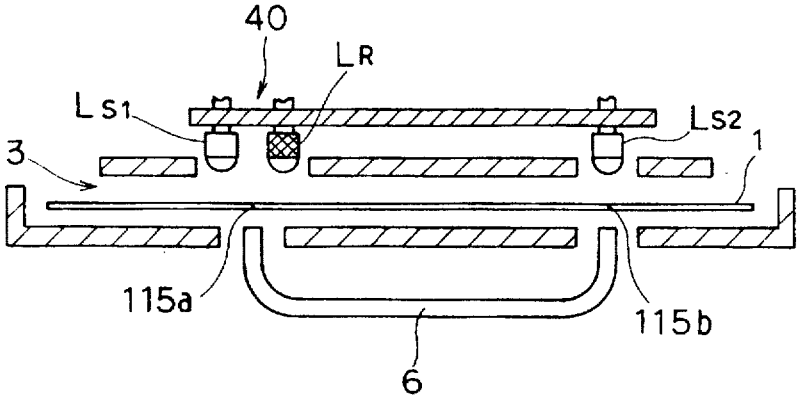
FIG. 15 sectionally shows an optical detection unit according to the sixth embodiment of the present invention.

FIG. 15 shows a basic structure of an optical detection unit for bill validation apparatus according to the sixth embodiment of the present invention. The optical detection unit of the sixth embodiment structurally resembles that of the fifth embodiment shown in FIG. 14. The optical detection unit of the sixth embodiment has a first light emitting elements $L_{S1}$ and a light receiving element $L_R$, which are actually combined to each other to form a light emitter-receiver unit 40, as in the case of the fifth embodiment shown in FIG. 14, a second light emitting element $L_{S2}$ disposed apart from the light emitter-receiver unit 40, and an optical fiber 6 that optically connects the light receiving element $L_R$ with the second light emitting element $L_{S2}$. In other words, the second light emitting element $L_{S2}$ is structurally a substitute for the second light receiving element $L_{R2}$ of the fifth embodiment.

In the sixth embodiment, light emission first takes place from the first light emitting element $L_{S1}$ in a first light emitting mode, and next from the second light emitting element $L_{S2}$ in a second light emitting mode. Such alternate light emissions are repeated consecutively. In the first light emitting mode, a portion of the light emitted from the first light emitting element $L_{S1}$ is absorbed by the bill 1 and a portion is reflected on the bill at a part 115*a* and received by the light receiving element $L_R$ as the first data element of the bill 1. In the second light emitting mode, a portion of the light emitted from the second light emitting element $L_{S2}$ onto a part 115*b* of the bill 1, which has not been reflected on, or absorbed by, the bill, transmits through the bill twice, at the parts 115*a* and 115*b*, by way of the optical fiber 6 and is received by the light receiving element $L_R$ as the second data element of the bill. The process of obtaining the first data element and the second data element is repeated consecutively as the first and the second light emitting elements $L_{S1}$, $L_{S2}$ are alternately and repeatedly energized.

Figure 16:
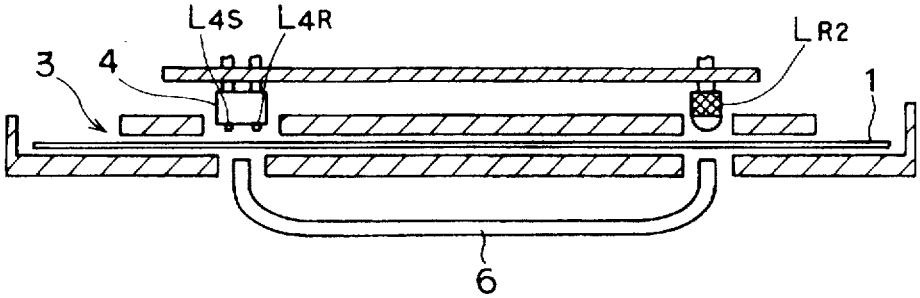
FIG. 16 sectionally shows an optical detection unit according to the seventh embodiment of the present invention.

FIG. 16 shows a basic structure of an optical detection unit for a bill validation apparatus according to the seventh embodiment of the present invention. Referring to FIG. 16 in conjunction with FIG. 14, the optical detection unit of the seventh embodiment resembles that of the fifth embodiment shown in FIG. 14 structurally and functionally. The structural difference of the seventh embodiment from the fifth embodiment is that the optical detection unit of the seventh embodiment has a light emitter-receiver module 4, which incorporates a light emitting element $L_{4S}$ and a light receiving element $L_{4R}$, as the replacement for the light emitting element $L_s$ and the first light receiving element $L_{R1}$ used in the fifth embodiment shown in FIG. 14. Other parts of the optical detection unit and the arrangements thereof of the seventh embodiment are the same as those of the fifth embodiment. The light emitting element $L_{4S}$ of the light emitter-receiver module 4 is optically connected with the light receiving element $L_{R2}$ by way of the optical fiber 6. This optical detection unit functions in the same manner as that of the fifth embodiment.

While the bill 1 is being transported through the optical detection unit of the seventh embodiment, a portion of the light emitted from the light emitting element $L_{4S}$ of the light emitter-receiver module 4 will be absorbed by the bill 1, a portion thereof will be reflected back by the bill 1 and received by the light receiving element $L_{4R}$ as the first data element of the bill 1, and a portion of the light emitted from the light emitting element $L_{4S}$ will transmit through the bill 1 twice by way of the optical fiber 6 and will be received by the second light receiving element $L_{R2}$ as the second data element of the bill 1.

Figure 17:
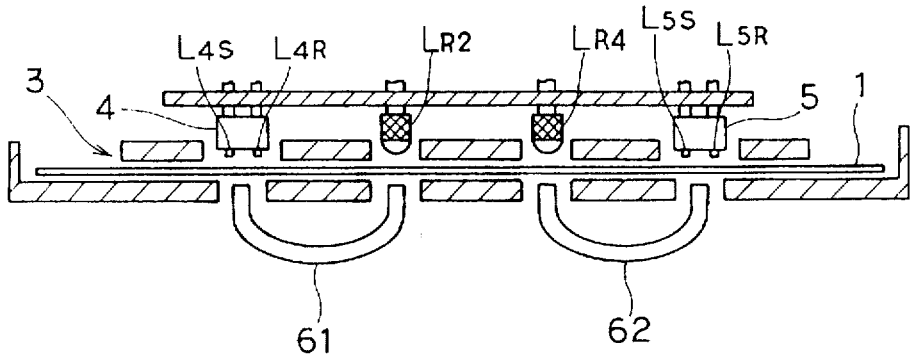
FIG. 17 shows an alternate embodiment of the seventh embodiment shown in FIG. 16.

FIG. 17 shows an alternate embodiment of the seventh embodiment. The difference of this embodiment from the seventh embodiment shown in FIG. 16 is that, in addition to a first set of a light emitter-receiver module 4, which contains light emitting and receiving elements $L_{4S}$, $L_{4R}$, a second light receiving element $L_{R2}$ and an optical fiber 61, a second set of a light emitter-receiver module 5, which contains light emitting and receiving elements $L_{5S}$, $L_{5R}$, a fourth light receiving element $L_{R4}$ and a second optical fiber 62, is arranged in alignment with a line orthogonal to the bill transport direction within the height of the bill 1. The function of each set of the optical elements in this embodiment is identical to that of the seventh embodiment explained above.

Figure 18:
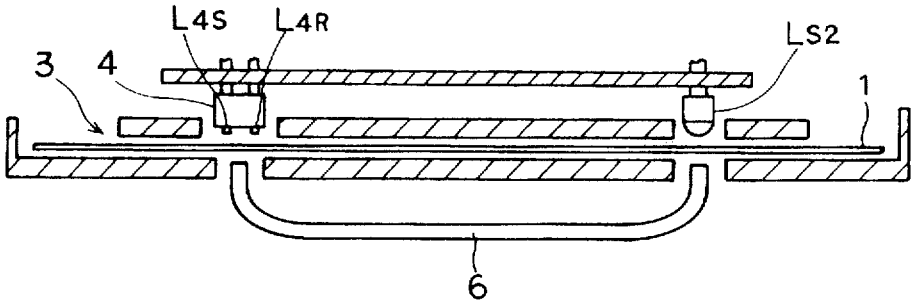
FIG. 18 sectionally shows an optical detection unit according to the eighth embodiment of the present invention.

FIG. 18 shows a basic structure of an optical detection unit for a bill validation apparatus according to the eighth embodiment of the present invention. Referring to FIG. 18 in conjunction with FIG. 15, the optical detection unit of the eighth embodiment resembles that of the sixth embodiment shown in FIG. 15 structurally and functionally. The structural difference of the eighth embodiment from the sixth embodiment is that the optical detection unit of the eighth embodiment has a light emitter-receiver module 4, which incorporates a light emitting element $L_{4S}$ and a light receiving element $L_{4R}$, as the replacement for the first light emitting element $L_{S1}$ and the light receiving element $L_R$ used in the sixth embodiment shown in FIG. 15. Other parts of the optical detection unit and the arrangements thereof of the eighth embodiment are the same as those of the sixth embodiment. The light receiving element $R_{4R}$ of the light emitter-receiver module 4 is optically connected with the second light emitting element $L_{S2}$ by way of the optical fiber 6. This optical detection unit functions in the same manner as that of the sixth embodiment.

While the bill 1 is being transported through the optical detection unit of the eighth embodiment, a portion of the light emitted from the light emitting element $L_{4S}$ of the light emitter-receiver module 4 will be absorbed by the bill 1, a portion thereof will be reflected back by the bill 1 and received by the light receiving element $L_{4R}$ of the light emitter-receiver module 4 as the first data element of the bill 1. A portion of the light emitted from the second light emitting element $L_{S2}$ will transmit through the bill 1 twice by way of the optical fiber 6 and will be received by the light receiving element $L_{4R}$ of the light emitter-receiver module 4 as the second data element of the bill 1. The light emissions take place from the light emitting element $L_{4S}$ of the light emitter-receiver module 4 and from the second light emitting element $L_{S2}$ alternately and consecutively.

Figure 19:
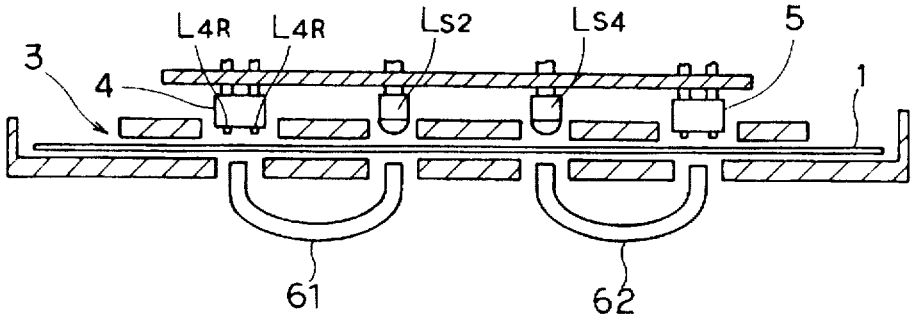
FIG. 19 shows an alternate embodiment of the eighth embodiment shown in FIG. 18.

FIG. 19 shows an alternate embodiment of the eighth embodiment. The difference of this embodiment from the eighth embodiment shown in FIG. 18 is that, in addition to a first set of a light emitter-receiver module 4, which contains light emitting and receiving elements $L_{4S}$, $L_{4R}$, a second light emitting element $L_{S2}$ and an optical fiber 61, a second set of a light emitter-receiver module 5, which contains light emitting and receiving elements $L_{5S}$, $L_{5R}$, a fourth light emitting element $L_{S4}$ and a second optical fiber 62, is arranged in alignment with a line orthogonal to the bill transport direction within the width of the bill 1. The function of each set of the optical elements in this embodiment is identical to that of the eighth embodiment explained above.

Any of the optical detection units of the present invention employing a plurality of light emitting elements in one set of light elements will be used with a light emission control unit that controls the light emission of each of the light emitting elements. This matter will be explained next.

Figure 20:
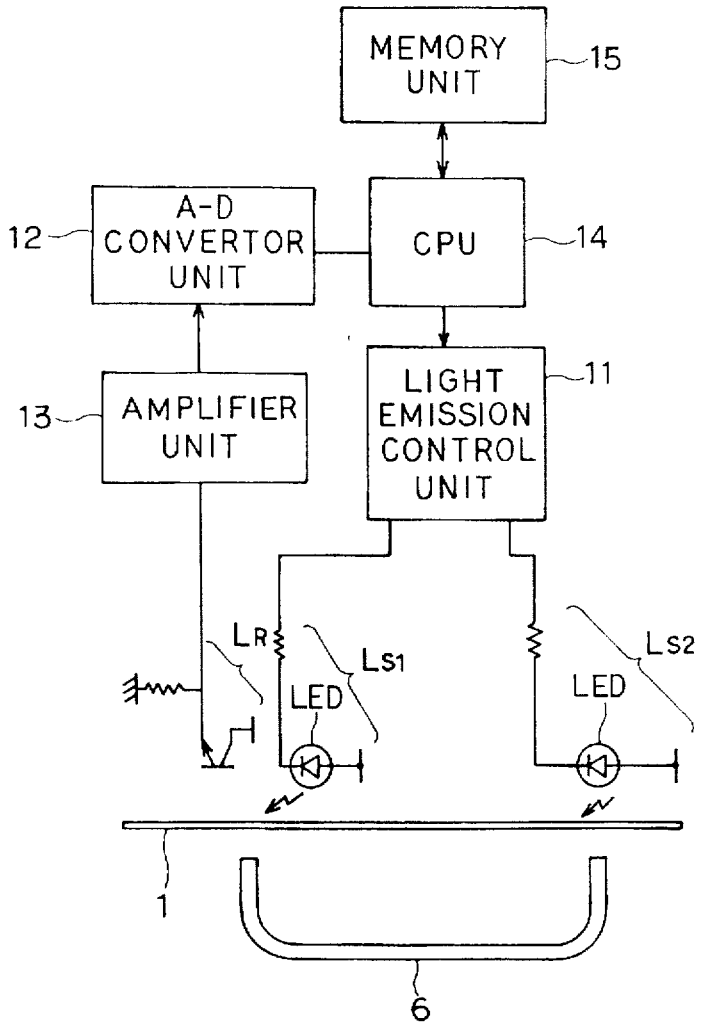
FIG. 20 shows a control circuit diagram for the optical detection unit of the sixth embodiment shown in FIG. 15.

FIG. 20 shows a control circuit diagram together with the optical elements for the optical detection unit of the sixth embodiment shown in FIG. 15. The control circuit includes a light emission control unit 11, which is electrically connected with each of the first light emitting element $L_{S1}$ and the second light emitting element $L_{S2}$, an amplifier unit 13, which is electrically connected with the light receiving element $L_R$, an A-D convertor unit 12, which is electrically connected with the amplifier unit 13, a central processing unit (CPU) 14, which is electrically connected with both the light emission control unit 11 and the A-D convertor unit 12, and a memory unit 15, which is electrically connected with the CPU 14. The CPU performs data processing with various data including the optical data obtained from the reflected lights and the transmitted lights collected by the light receiving element $L_R$. The memory unit 15 stores necessary information for the CPU 14 to perform the processing. Light emitting diodes (LEDs) are utilized for both the light emitting elements $L_{S1}$ and $L_{S2}$ and a photo transistor is utilized for the light receiving element $L_R$. The light emitting elements $L_{S1}$ and $L_{S2}$ are individually connected to the collectors of emitter-grounded type transistors (not shown) employed in the light emission control unit 11.

In the optical detection unit of this embodiment, the first and the second light emitting elements $L_{S1}$, $L_{S2}$ are selectively and alternately energized in a predetermined sequence. Either of the first light emitting element $L_{S1}$ of the light emitter-receiver unit 40 (FIG. 15) or the second light emitting element $L_{S2}$ is selectively energized at one time by the light emission control unit 11 according to the command signals received from the CPU 14, and, as described before, the optical data elements of the lights having reflected on the bill 1 or transmitted through the bill and received by the light receiving element $L_R$ are obtained. An electrical signal representing the portion of the light energy emitted from the first light emitting element $L_{S1}$, reflected on the bill, and received by the light receiving element $L_R$ is amplified to a proper signal level by the amplifier unit 11, converted to a digital signal by the A-D convertor unit 12 and is stored at the memory unit 15 through the CPU 14. Likewise, an electrical signal representing the portion of the light energy emitted from the second light emitting element $L_{S2}$, having transmitted through the bill 1 twice by way of the optical fiber 6, and received by the light receiving element $L_R$ is also amplified to a proper signal level by the amplifier unit 11, converted to a digital signal by the A-D convertor unit 12 and is stored at the memory unit 15 through the CPU 14. The above optical detection processes are repeated until the bill 1 has passed through the optical detection unit.

Figure 21:
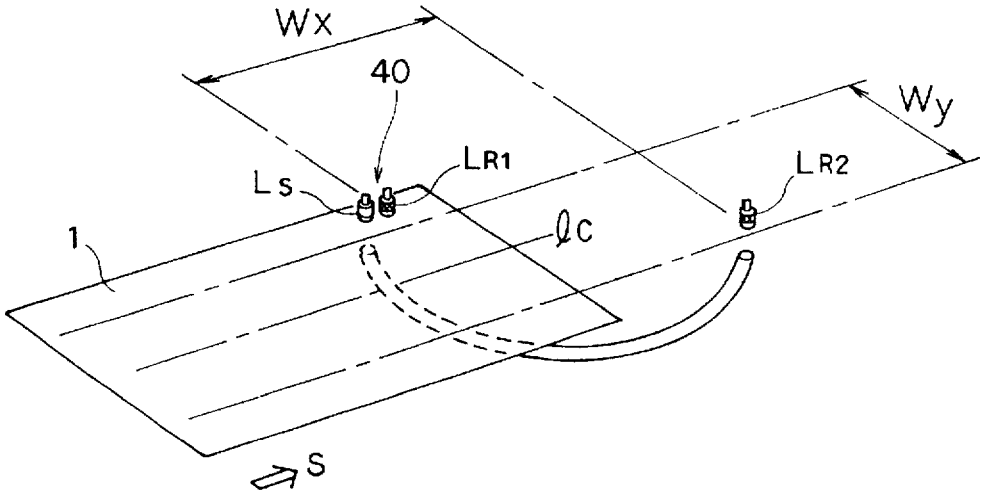
FIG. 21 is a perspective view particularly illustrating a positional arrangement of the light elements for a special alternate embodiment of the optical detection unit of the fifth embodiment shown in FIG. 14.

FIG. 21 is a perspective view particularly illustrating a positional arrangement of the light elements for a special alternate embodiment of the optical detection unit of the fifth embodiment shown in FIG. 14. In FIG. 21, the light emitter-receiver unit 40, which includes the light emitting element $L_S$ and the first light receiving element $L_{R1}$, and the second light receiving element $L_{R2}$ are disposed further apart from each other in the bill transport direction that is indicated by the arrow affixed with the letter "S", and the optical fiber 6 is disposed so as to optically connect the light emitter-receiver unit 40 with the second light receiving element $L_{R2}$. The letters "Wx" and "Wy" represent the distances between the light emitter-receiver unit 40 and the second light receiving elements $L_{S2}$ measured in the bill transport direction S and in the direction orthogonal to the bill transport direction S, respectively. The letters "lc" denote the longitudinal center of the bill 1. The distance Wy is smaller than the height of the bill and, in this case, the distance Wx is smaller than the longitudinal dimension (i.e. width) of the bill.

Figure 22:
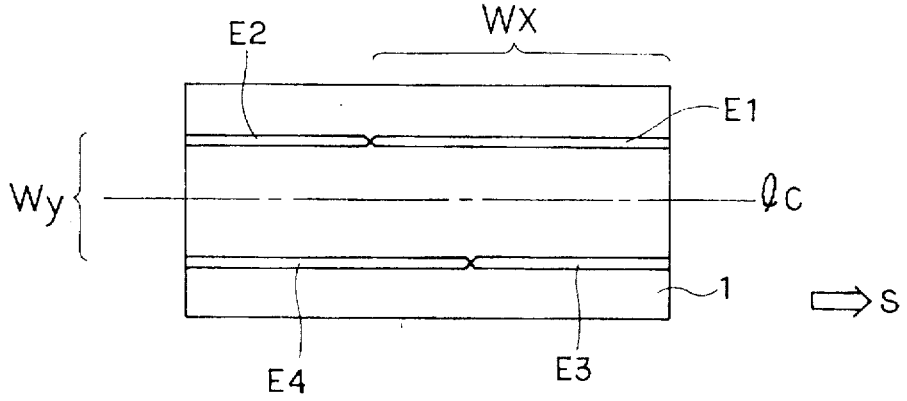
FIG. 22 shows optical sensing regions of a bill according to the positional arrangement of the optical elements of the optical detection unit shown in FIG. 21.

FIG. 22 shows optical sensing regions of the bill according to the positional arrangement of the optical elements of the optical detection unit as shown in FIG. 21. Referring to FIGS. 21 and 22, the bill 1 has strip-formed optical sensing regions E1, E2, E3 and E4. After the leading edge of the bill 1 has reached immediately under the light emitter-receiver unit 40, a portion of the light having reflected on the bill in the sensing region E1 or having transmitted through the bill in the sensing region E1 will be sampled. After the leading edge of the bill has reached immediately under the second light receiving element $L_{R2}$, a portion of the light having reflected on the bill in the sensing region E2 or a portion of the light having transmitted through the bill in both the sensing regions E2 and E3 will be sampled. After the trailing edge of the bill has passed immediately under the light emitter-receiver unit 40, a portion of the light having transmitted through the bill in the sensing region E4 will be sampled.

Figure 23:
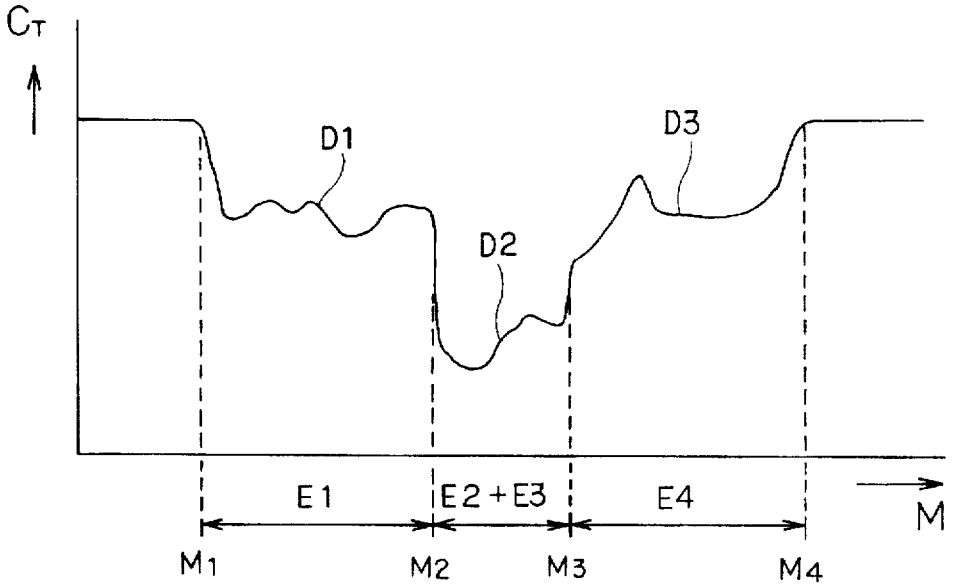
FIG. 23 shows a sampled data pattern of the light amounts transmitted through a bill obtained by the optical detection unit according to the arrangement of the light elements shown in FIG. 21.

FIG. 23 shows a sampled data pattern of the received light amounts obtained by the second light receiving element $L_{R2}$ of the optical detection unit according to the arrangement shown in FIG. 21, in which the detected light amount ($C_T$) varies as the travel distance (M) of the bill varies. Referring to FIG. 23 in conjunction with FIGS. 21 and 22, "M1", "M2", "M3" and "M4" respectively represent the travel distances of the bill 1 when the leading edge of the bill reaches immediately under the light emitter-receiver unit 40, when the leading edge reaches immediately under the second light receiving element $L_{R2}$, when the trailing edge of the bill has just passed under the light emitter-receiver unit 40, and when the trailing edge has just passed under the second light receiving element $L_{R2}$.

Figure 24:
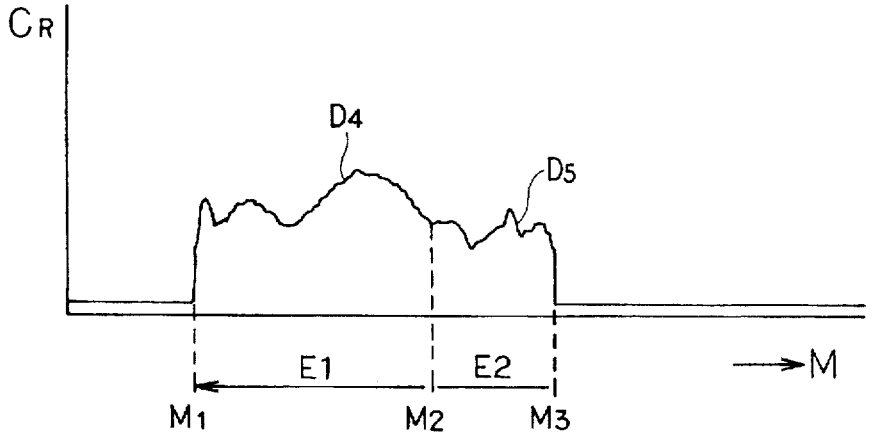
FIG. 24 shows a sampled data pattern of the received light amounts reflected back from a bill obtained by the optical detection unit according to the special positional arrangement of the optical elements shown in FIG. 21.

FIG. 24 shows a sampled data pattern of the received light amounts reflected back from the surface of the bill 1 obtained by the first light receiving element $L_{R1}$ of the optical detection unit according to the special positional arrangement of the optical elements shown in FIG. 21, in which the detected reflected light amount ($C_R$) varies as the travel distance (M) of the bill varies. Referring to FIG. 24 in conjunction with FIGS. 21 and 22, "M1", "M2" and "M3" respectively represent the travel distances of the bill when the leading edge of the bill reaches immediately under the light emitter-receiver unit 40, when the leading edge reaches immediately under the second light receiving element $L_{R2}$, and when the trailing edge of the bill has just passed under the light emitter-receiver unit 40.

Referring to FIG. 23 in conjunction with FIGS. 21 and 22, a first optical data pattern D1 shown in FIG. 23 is obtained when the leading edge of bill 1 is within the travel distance range between "M1" and "M2", when the light beam transmits through the optical sensing region E1; a second optical data pattern D2 is obtained when the leading edge is within the travel distance range between "M2" and "M3", when the light beam transmits through both the optical sensing regions E2 and E3; and a third optical data pattern D3 is obtained when the trailing edge of the bill is within the travel distance range between "M3" and "M4", when the light beam transmits through the optical sensing region "E4".

Referring to FIG. 24 in conjunction with FIGS. 21 and 22, a fourth optical data pattern D4 is obtained when the leading edge of the bill 1 is within the travel distance range between "M1" and "M2", when the light beam is reflected on the optical sensing region E1; and the fifth optical data pattern D5 is obtained when the leading edge is within the travel distance range between "M2" and "M3", when the light beam is reflected on the optical sensing region E2.

However, in reference to FIG. 21, if the distance Wx is made greater than the longitudinal dimension (i.e. width) of the bill 1, the light beam will not transmit through the bill more than once, and the optical light patterns obtained in such a case will not include a pattern of twice attenuated light energy, such as "D2" in FIG. 23.

In the case of the optical detection unit of the fifth embodiment shown in FIG. 14, if the first and the second light receiving elements $L_{R1}$ and $L_{R2}$ are selected so that the peak spectral wave length light receiving sensitivities thereof are different from each other, data elements based on different light receiving sensitivities of the light receiving elements are obtained regarding the bill 1.

In the case of the optical detection unit of the sixth embodiment shown in FIG. 15, if the first and the second light emitting elements $L_{S1}$ and $L_{S2}$ are selected so that the spectral wave length light emitting ranges thereof are different from each other, data elements based on different light emitting ranges of the light emitting elements are obtained regarding the bill 1.

For example, the spectral wave length light emitting range of the light emitted from the light emitting element $L_S$ is determined to be greater than a range 900~1,000 nm, and photo transistors having peak spectral wave length sensitivities 900 nm and 1,000 nm may be selected as the first and the second light receiving elements $L_{R1}$ and $L_{R2}$, respectively.

Figure 25:
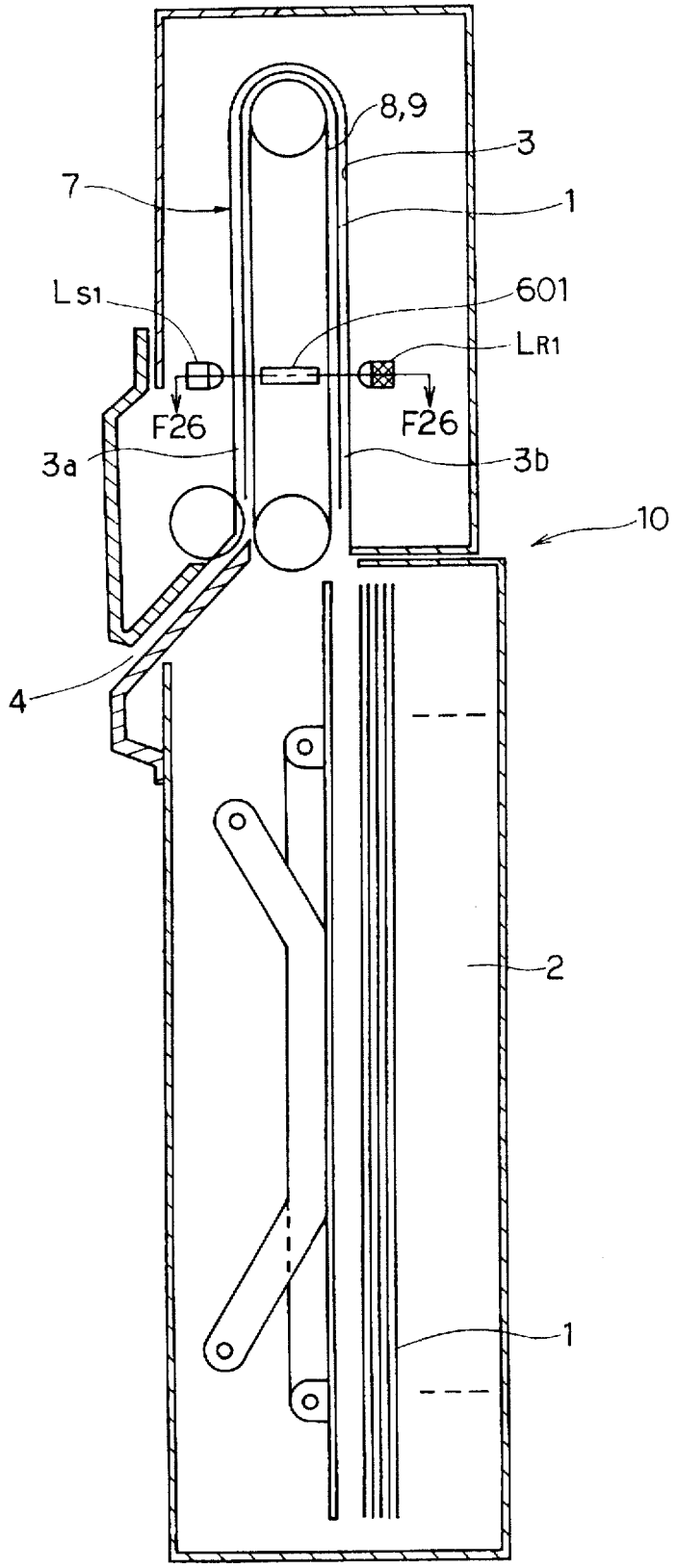
FIG. 25 is a side elevational sectional view of a vertical-type bill validation apparatus that employs a vertically installed optical detection unit according to the present invention.
Figure 30:
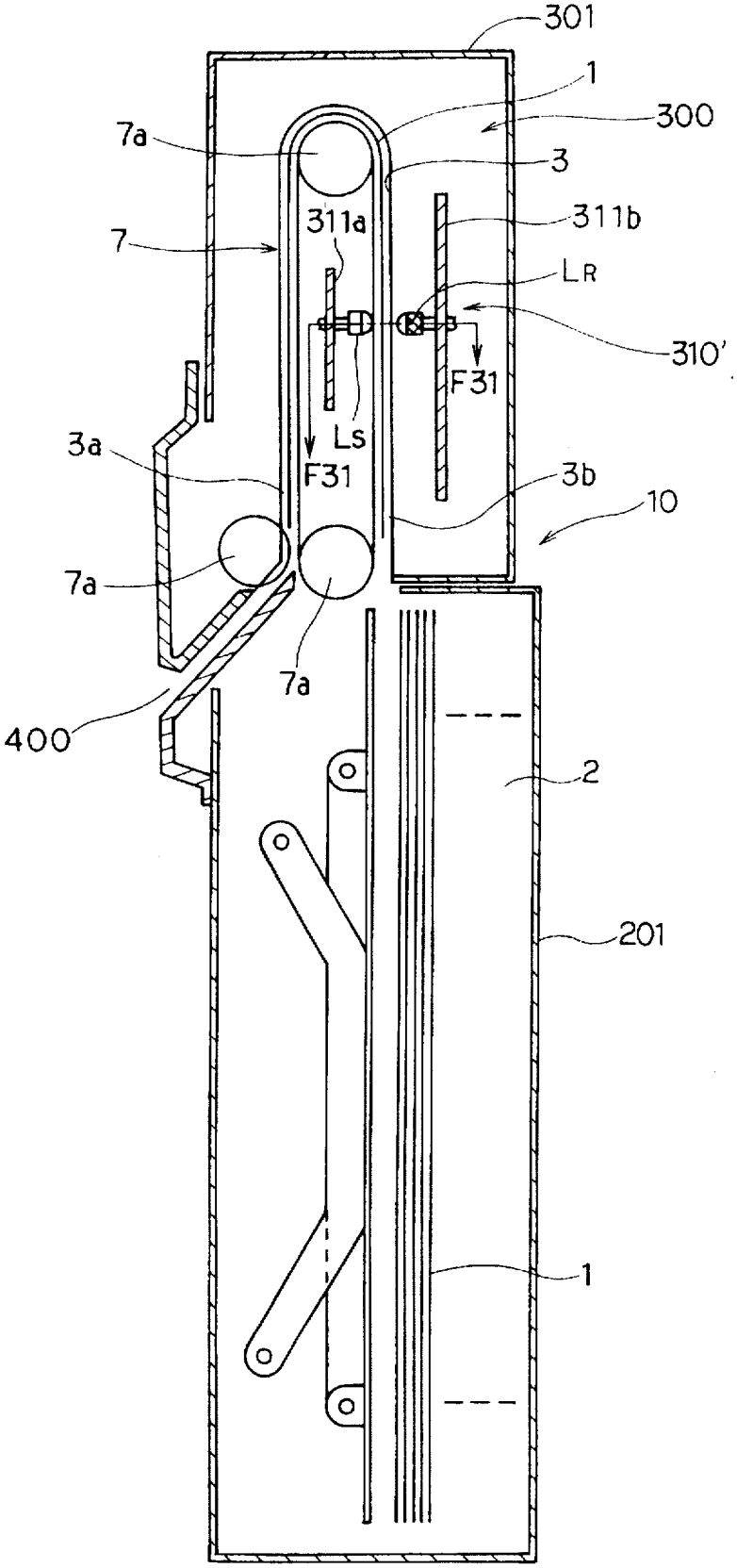
FIG.30 PRIOR ART
FIG. 30 is a side elevational sectional view of a vertical-type bill validation apparatus employing a conventional optical detection unit.
Figure 31:
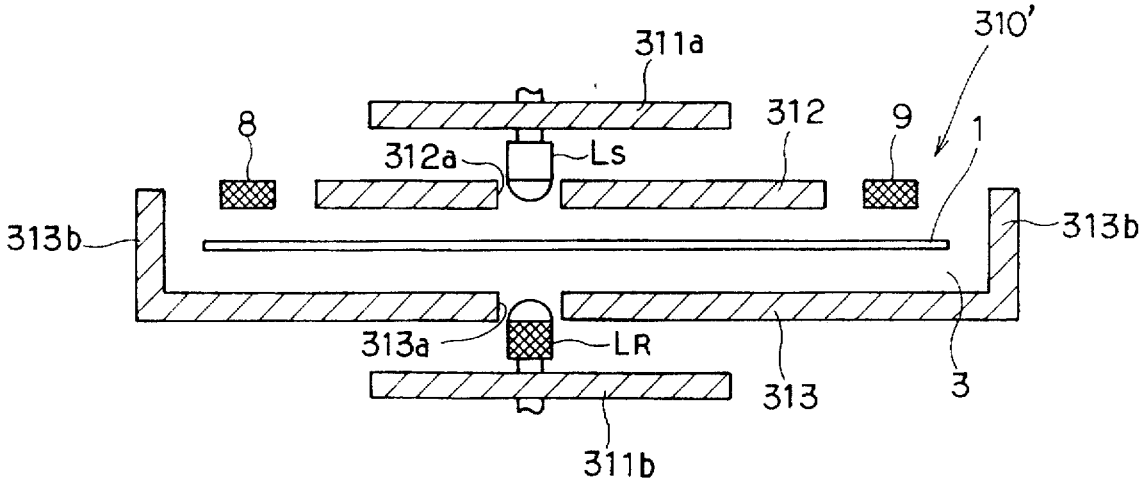
FIG.31 PRIOR ART
FIG. 31 is a top sectional view, taken along line F31—F31 of FIG. 30, of the conventional optical detection unit.
Figure 32:
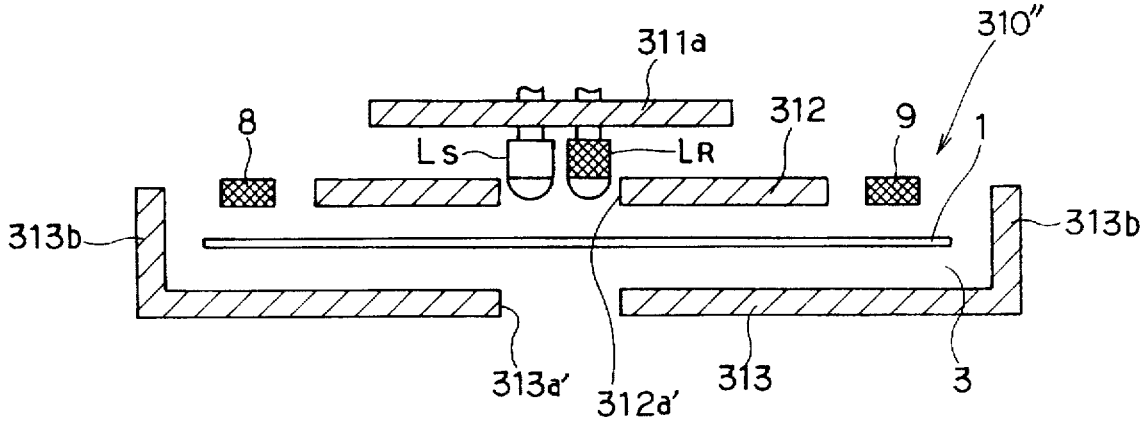
FIG.32 PRIOR ART
FIG. 32 is a sectional view of another type of the conventional optical detection unit.

FIG. 25 is a side elevational sectional view of a basic structure of a vertical-type bill validation apparatus that employs a vertically installed optical detection unit according to the ninth embodiment of the present invention. Many of the existing bill validation apparatuses for automatic vending machines are installed upright in the vending machines as shown in FIG. 25 or 30. The structure of the validation apparatus shown in FIG. 25 is identical to that of the conventional validation apparatus shown in FIG. 30 except for the optical detection unit. Like reference characters denote like components having like functions between the FIGS. 25 and 30.

Referring to FIG. 25, a bill 1 inserted into a bill insertion slot 4 is first transported upwardly in an upward path 3*a* of a bill transport path 3 along transport belts 8, 9 (shown in FIG. 26 in detail) of a bill transport mechanism 7, turned around 1800° at the top of the bill transport path 3, then downwardly transported in a downward path 3*b* thereof toward a bill accommodation chamber 2. The bill transport mechanism 7 including the transport belts 8, 9 is disposed in an approximate center in the front-to-rear direction of the body of the bill validation apparatus 10 and between the upward path 3*a* and the downward path 3*b* of the generally inverted-U-shaped bill transport path 3.

In the case of a conventional light-transmission type optical detection unit, it is necessary that either the light emitting element with a circuit board therefor or the light receiving element with a circuit board therefor must be disposed on the side of the bill transport mechanism 7 (i.e. on the inside of the inverted-U-shaped bill transport path 3) and the other light element on the outside of the bill transport path 3, because the light emitting and receiving elements are always disposed on the sides of the bill transport path opposing to each other (as shown in FIG. 30). However, in the case of an optical detection unit according to the present invention, light emitting and receiving elements are both disposed on the same side of the bill transport path and an optical fiber, or other light guiding means, is disposed on the opposite side. This unique feature of the present invention makes the arrangement of the optical elements shown in FIG. 25 possible.

In FIG. 25, the light emitting and receiving elements $L_{S1}$, $L_{R1}$ are both disposed on the outside (front side, or rear side, as viewed in FIG. 25) of the bill transport path 3 (i.e. on the side opposite to the bill transport mechanism 7), and the optical fiber 601 is disposed on the opposite side (i.e. on the side of the bill transport mechanism 7). The light emitting and receiving elements $L_{S1}$, $L_{R1}$ are disposed on the sides of the upward path 3a and the downward path 3b, respectively, of the bill transport path 3 and are interposed by the bill transport mechanism 7. The optical fiber 601 extends in the middle space, where the bill transport path 7 is provided, so as to form an optical channel between the light emitting and receiving elements $L_{S1}$, $L_{R1}$.

Figure 26:
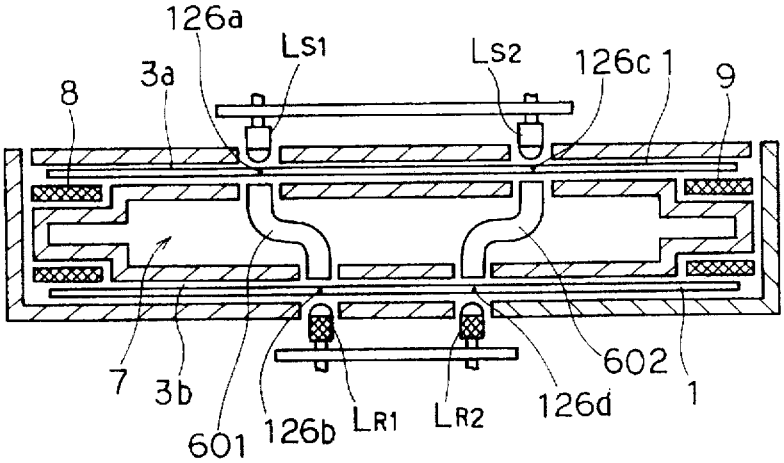
FIG. 26 is a top sectional view, taken along line F26—F26 of FIG. 25, of an optical detection unit according to the ninth embodiment of the present invention.

FIG. 26 is a sectional view, taken along line F26—F26 of FIG. 25, of an optical detection unit according to the ninth embodiment of the present invention. Referring to FIG. 26 in conjunction with FIG. 25, the optical detection unit has a bill transport path 3, including an upward path 3a and a downward path 3b, a pair of first light emitting element $L_{S1}$ and second light emitting element $L_{S2}$ disposed apart from each other on the outside (front side) of the upward path 3a, a pair of first light receiving element $L_{R1}$ and second light receiving element $L_{R2}$ disposed apart from each other on the outside (rear side) of the downward path 3b, a first optical fiber 601, and a second optical fiber 602. The first optical fiber 601 optically interconnects the first light emitting element $L_{S1}$ with the first light receiving element $L_{R1}$ through the area of the bill transport mechanism 7. The second optical fiber 602 optically interconnects the second light emitting element $L_{S2}$ with the second light receiving element $L_{R2}$ through the area of the bill transport mechanism 7. A pair of endless bill transport belts 8 and 9 are disposed near the side end sections of the bill transport path 3.

In this ninth embodiment, the first and the second light emitting elements $L_{S1}$ and $L_{S2}$ are disposed apart from each other on the front side of the upward path 3a, the first and the second light receiving elements $L_{R1}$ and $L_{R2}$ are disposed apart from each other on the rear side of the downward path 3b. The positions of the first and the second light receiving elements $L_{R1}$ and $L_{R2}$ are on the opposite side of those of the first and the second light emitting elements $L_{S1}$ and $L_{S2}$ with respect to the bill transport mechanism 7 at a common level, and the positions of the first and the second light receiving elements $L_{R1}$ and $L_{R2}$ are inwardly offset to those of the first and the second light emitting elements $L_{S1}$ and $L_{S2}$, respectively, along a line orthogonal to a bill transport direction.

Therefore, when the bill 1 passes by the first and the second light emitting elements $L_{S1}$ and $L_{S2}$ in the upward path 3a, the light beams will transmit through two longitudinal strip scan regions of the bill, which respectively oppose the first and the second light emitting elements $L_{S1}$ and $L_{S2}$, and when the bill passes by the first and the second light receiving elements $L_{R1}$ and $L_{R2}$ in the downward path 3b, the light beams will transmit through two additional longitudinal strip scan regions of the bill, which respectively oppose the first and the second light receiving elements $L_{R1}$ and $L_{R2}$. Thus, two pairs of optical data elements of the transmitted lights can be obtained. This increased number of the sampled data will enhance the validation accuracy.

Since the bill 1 is turned around 180° at the top of the bill transport path 3, the front side surface of the bill in the upward path 3a will face rear in the downward path 3b. For explanation purposes, the front-facing surface side of the bill in the upward path 3a (which will be the rear-facing surface side in the downward path 3b) will hereinafter be called "the first surface side" and the other surface side "the second surface side".

The first light emitting element $L_{S1}$ emits light onto a part 126a, which is in the upward path 3a, of the bill 1 on the first surface side so that a portion of the emitted light transmits through the bill from the first surface side to the second surface side at the part 126a. The light having transmitted through the bill is guided by the first optical fiber 601 onto a part 126b, which is in the downward path 3b, of the bill on the second surface side so that a portion of the guided light transmits through the bill from the second surface side to the first surface side at the part 126b. Then the first light receiving element $L_{R1}$ receives a portion of the light having transmitted through the bill at the part 126b, and the light so received is converted to an optical data pattern for analysis. Similar light emitting, guiding and receiving functions are performed with the second light emitting element $L_{S2}$, the second optical fiber 602 and the second light receiving element $L_{R2}$, while a second light beam transmits through the bill at parts 126c and 126d, and a second optical data pattern will be obtained. The parts 126a and 126b, and the parts 126c and 126d are respectively offset from each other in a direction orthogonal to a sheet transport direction.

Figure 27:
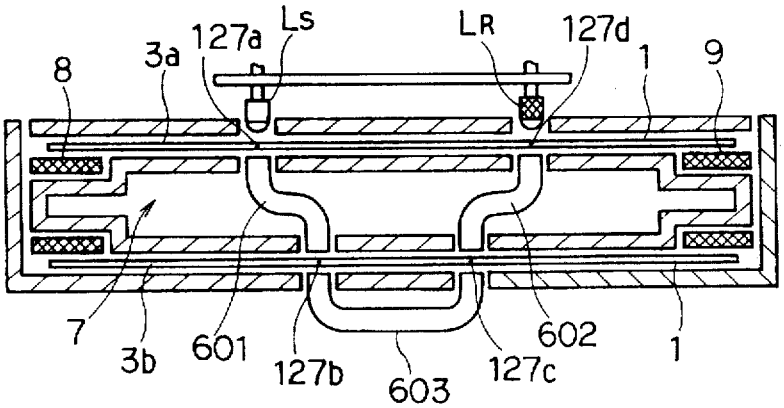
FIG. 27 is a top sectional view of an optical detection unit according to the tenth embodiment of the present invention.

FIG. 27 is a top sectional view of an optical detection unit according to the tenth embodiment of the present invention. The basic structure of this optical detection unit is similar to that of the ninth embodiment shown in FIG. 26, but the number and arrangement of light emitting and receiving elements and optical fibers are different. Like reference characters denote like components between FIGS. 26 and 27. In FIG. 27, a light emitting element $L_s$ and a light receiving element $L_R$ are disposed, apart from each other, on the outside (front side) of the upward path 3a, optical fibers 601 and 602 are disposed extending between the upward path 3a and the downward path 3b through the area of the bill transport mechanism 7, and an optical fiber 603 is disposed on the outside (rear side) of the downward path 3b in the manner that the light emitting element $L_s$ and the light receiving element $L_R$ are optically connected with each other by way of the three optical fibers 601, 602 and 603 so that a portion of the light beam emitted from the light emitting element $L_s$ can transmit to the light receiving element $L_R$ through the optical fibers 601, 603 and 602, in this order, transmitting through the upward path 3a twice and the downward path 3b twice in the way. The ends of the optical fiber 603 are disposed inwardly offset from the respective positions of the light emitting and receiving elements $L_s$ and $L_R$ along a line orthogonal to a bill transport direction. In this tenth embodiment, one circuit board and a pair of light emitting and receiving elements can be saved as compared to the ninth embodiment shown in FIG. 26.

The light emitting element $L_S$ emits light onto a part 127a, which is in the upward path 3a, of the bill 1 on the first surface side so that a portion of the emitted light transmits through the bill from the first surface side to the second surface side at the part 127a. The light having transmitted through the bill is guided by the first optical fiber 601 onto a part 127b, which is in the downward path 3b, of the bill on the second surface side so that a portion of the guided light transmits through the bill from the second surface side to the first surface side at the part 127b. The light having transmitted through the bill at the part 127bin the second path 3b is further guided onto a part 127c, which is also in the downward path 3b, of the bill by the third optical fiber 603 so that a portion of the light so guided by the third optical fiber 603 transmits through the bill from the first surface side to the second surface side at the part 127c. The light having transmitted through the bill at the part 127c in the second path 3b is guided onto a part 127d, which is in the upward path 3a, of the bill by the second optical fiber 602 so that a portion of the light so guided by the second optical fiber 602 transmits through the bill from the second surface side to the first surface side at the part 127d. Then the light receiving element $L_R$ receives a portion of the light having transmitted through the bill at the part 127d from the second surface side to the first surface side, and the light so received is converted to an optical data pattern for analysis. The parts 127a and 127b, and the parts 127c and 127d are respectively offset from each other in a direction orthogonal to a bill transport direction.

Figure 28:
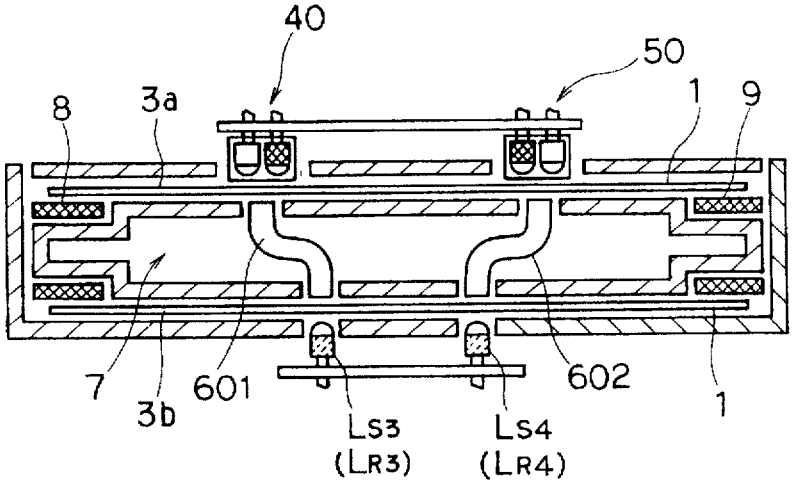
FIG. 28 is a top sectional view of an optical detection unit according to the eleventh embodiment of the present invention.

FIG. 28 is a top sectional view of an optical detection unit according to the eleventh embodiment of the present invention. The basic structure of this optical detection unit is similar to that of the ninth embodiment shown in FIG. 26. In the eleventh embodiment, a first light emitter-receiver unit 40 and a second light emitter-receiver unit 50 are used in place of the first light emitting element $L_S$ and the second light emitting element $L_{S2}$, respectively, of the ninth embodiment shown in FIG. 26. The eleventh embodiment has two types. In the first type, a third light emitting element $L_{S3}$ and a fourth light emitting element $L_{S4}$ are used in place of the first light receiving element $L_{R1}$ and the second light receiving element $L_{R2}$, respectively, of the ninth embodiment shown in FIG. 26. In the second type, a third light receiving element $L_{R3}$ and a fourth light receiving element $L_{R4}$ are used just like the first light receiving element $L_{R1}$ and the second light receiving element $L_{R2}$, respectively, of the ninth embodiment shown in FIG. 26.

Figure 29:
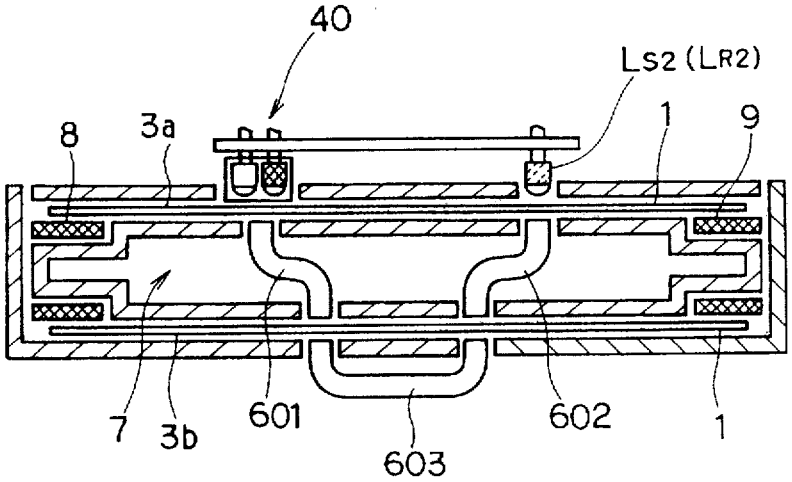
FIG. 29 is a top sectional view of an optical detection unit according to the twelfth embodiment of the present invention.

FIG. 29 is a top sectional view of an optical detection unit according to the twelfth embodiment of the present invention. The basic structure of this optical detection unit is similar to that of the tenth embodiment shown in FIG. 27. In the twelfth embodiment, a light emitter-receiver unit 40 is used in place of the light emitting element $L_S$ of the tenth embodiment shown in FIG. 27, and a second light emitting element $L_{S2}$ or a second light receiving element $L_{R2}$ is used in place of the light receiving element $L_R$ of the tenth embodiment shown in FIG. 27.

The light emitter-receiver units 40, 50 and the optical fibers 601, 602, 603 used in the eleventh and/or the twelfth embodiments function in coordination with the corresponding light elements to obtain optical data elements from the lights having transmitted through or reflected on the bill to be validated in the same manner as described above pertaining to the other embodiments.

In the optical detection units of any of the above described embodiments, in the case plural number of light emitting elements or light receiving elements are used, light emitting elements having different spectral wave length light emitting ranges or light receiving elements having different peak spectral wave length light receiving sensitivities can be used. The positions of the light emitting or receiving elements can be changed easily as compared with the case of a conventional optical detection unit because, in the present invention, the light emitting and receiving elements are always on one side of the bill transport path and rerouting of optical fibers is rather easy.

It should also be understood that various changes and modifications may be made in the above described embodiments which provide the characteristics of the present invention without departing from the spirit and principle thereof particularly as defined in the following claims.

What is claimed is:

1. A method of optically detecting a printed value sheet for a printed value sheet validation apparatus, comprising the steps of:

(a) causing a light emitting element to emit light onto a first part of a printed value sheet on a first surface side thereof while said sheet is being transported in a predetermined direction in a sheet transport path so that a portion of the emitted light transmits through said sheet at said first part from said first surface side to a second surface side thereof;

(b) guiding the light having transmitted through said sheet at said first part from said first surface side to said second surface side onto a second part of said sheet on said second surface side by a first light guiding means so that a portion of the guided light transmits through said sheet at said second part from said second surface side to said first surface side;

(c) guiding the light having transmitted through said sheet at said second part from said second surface side to said first surface side onto a third part of said sheet on said first side by a second light guiding means so that a portion of the light guided by said second light guiding means transmits through said sheet at said third part from said first surface side to said second surface side;

(d) guiding the light having transmitted through said sheet at said third part from said first surface side to said second surface side onto a fourth part of said sheet on said second side by a third light guiding means so that a portion of the light guided by said third light guiding means transmits through said sheet at said fourth part from said second surface side to said first surface side;

(e) causing a light receiving element to receive a portion of the light having transmitted through said sheet at said fourth part from said second surface side to said first surface side; and (f) converting the light received by said light receiving element to an optical data pattern for analysis.

2. A method of optically detecting a printed value sheet according to claim 1, wherein said first, second and third light guiding means are optical fibers.

3. A method of optically detecting a printed value sheet for a printed value sheet validation apparatus, comprising the steps of:

(a) causing a first light emitting element to emit light onto a first part of a printed value sheet on a first surface side thereof while said sheet is being transported in a predetermined direction in a sheet transport path so that a portion of the emitted light is reflected on said sheet;

(b) causing a light receiving element, which is disposed in a proximity of said first light emitting element, to receive a portion of the light having reflected on said sheet;

(c) converting the light received by said light receiving element to a first optical data pattern for analysis;

(d) causing a second light emitting element to emit light onto a second part of said sheet on said first surface side while said sheet is being transported in said predetermined direction in said sheet transport path so that a portion of the light emitted from said second light emitting element transmits through said sheet at said second part from said first surface side to a second surface side thereof;

(e) guiding the light having transmitted through said sheet at said second part from said first surface side to said second surface side onto said first part of said sheet on said second surface side by a light guiding means so that a portion of the guided light transmits through said sheet at said first part from said second surface side to said first surface side;

(f) causing said light receiving element to receive a portion of the light having transmitted through said sheet at said first part from said second surface side to said first surface side; and (g) converting the light received by said light receiving element after transmitting through said sheet at said first part from said second surface side to said first surface side to a second optical data pattern for analysis.

4. A method of optically detecting a printed value sheet according to claim 3, wherein said light guiding means is an optical fiber.

5. A method of optically detecting a printed value sheet according to claim 3, wherein said first light emitting element and said second light emitting element have respective spectral wave length light emitting ranges that are different from each other.

6. A method of optically detecting a printed value sheet for a printed value sheet validation apparatus, comprising the steps of:

(a) forming a generally U-shaped sheet transport path so that a printed value sheet is transported therein, said sheet having a first surface side that faces an outside of said U-shaped sheet transport path and a second surface side that faces an inside of said U-shaped sheet transport path, said U-shaped sheet transport path including a first path and a second path in a manner that said first path and said second path are disposed opposing to each other;

(b) causing a light emitting element to emit light onto a first part, which is in said first path, of said sheet on said first surface side so that a portion of the emitted light transmits through said sheet at said first part from said first surface side to said second surface side;

(c) guiding the light having transmitted through said sheet at said first part from said first surface side to said second surface side by an optical fiber onto a second part, which is in said second path, of said sheet on said second surface side so that a portion of the guided light transmits through said sheet at said second part from said second surface side to said first surface side; and (d) causing a light receiving element to receive a portion of the light having transmitted through said sheet at said second part from said second surface side to said first surface side; and (e) converting the light received by said light receiving element to an optical data pattern for analysis.

7. A method of optically detecting a printed value sheet according to claim 6, wherein said first part and said second part of said sheet are offset from each other in a direction orthogonal to a sheet transport direction.

8. A method of optically detecting a printed value sheet for a printed value sheet validation apparatus, comprising the steps of:

(a) forming a generally U-shaped sheet transport path so that a printed value sheet is transported therein, said sheet having a first surface side that faces an outside of said U-shaped sheet transport path and a second surface side that faces an inside of said sheet transport path, said U-shaped sheet transport path including a first path and a second path in a manner that said first path and said second path are disposed opposing to each other;

(b) causing a light emitting element to emit light onto a first part, which is in said first path, of said sheet on said first surface side so that a portion of the emitted light transmits through said sheet at said first part from said first surface side to said second surface side;

(c) guiding the light having transmitted through said sheet at said first part from said first surface side to said second surface side onto a second part, which is in said second path, of said sheet on said second surface side by a first optical fiber so that a portion of the guided light transmits through said sheet at said second part from said second surface side to said first surface side;

(d) guiding the light having transmitted through said sheet at said second part from said second surface side to said first surface side onto a third part, which is in said second path, of said sheet on said first surface side by a second optical fiber so that a portion of the light guided by said second optical fiber transmits through said sheet at said third part from said first surface side to said second surface side;

(e) guiding the light having transmitted through said sheet at said third part from said first surface side to said second surface side onto a fourth part, which is in said first path, of said sheet on said second surface side by a third optical fiber so that a portion the light guided by said third optical fiber transmits through said sheet from said second surface side to said first surface side;

(f) causing a light receiving element to receive a portion of the light having transmitted through said sheet at said fourth part from said second surface side to said first surface side; and (g) converting the light received by said light receiving element to an optical data pattern for analysis.

9. A method of optically detecting a printed value sheet according to claim 8, wherein said first part and said second part of said sheet are offset from each other in a direction orthogonal to a sheet transport direction, and said third part and said fourth part of said sheet are offset from each other in a direction orthogonal to the sheet transport direction.

* * * * *